US007934787B2

(12) United States Patent
Yoshida

(10) Patent No.: US 7,934,787 B2
(45) Date of Patent: May 3, 2011

(54) INKJET RECORDING DEVICE CAPABLE OF CALIBRATING FEEDING AMOUNT OF RECORDING MEDIUM

(75) Inventor: Yasunari Yoshida, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 970 days.

(21) Appl. No.: 11/646,427

(22) Filed: Dec. 28, 2006

(65) Prior Publication Data

US 2007/0146405 A1 Jun. 28, 2007

(30) Foreign Application Priority Data

Dec. 28, 2005 (JP) ..... P2005-380141
Dec. 28, 2005 (JP) ..... P2005-380144

(51) Int. Cl.
*B41J 29/38* (2006.01)

(52) U.S. Cl. ..... 347/16; 347/19

(58) Field of Classification Search ..... None
See application file for complete search history.

(56) References Cited

U.S. PATENT DOCUMENTS

| | | | | |
|---|---|---|---|---|
| 5,523,848 | A * | 6/1996 | Musso et al. | 358/296 |
| 5,602,571 | A | 2/1997 | Suda et al. | |
| 6,761,425 | B2 | 7/2004 | Kawaguchi et al. | |
| 2002/0037191 | A1 * | 3/2002 | Lesniak et al. | 400/582 |

FOREIGN PATENT DOCUMENTS

| | | | |
|---|---|---|---|
| JP | H04-148958 | A | 5/1992 |
| JP | 2001-001584 | A | 1/2001 |
| JP | 2001-88377 | A | 4/2001 |
| JP | 2002-254736 | A | 9/2002 |
| JP | 2004-175092 | A | 6/2004 |
| JP | 2005-170546 | A | 6/2005 |

OTHER PUBLICATIONS

Japan Patent Office, Office Action for Patent Application No. JP 2005-380144 (counterpart to above-captioned patent application), mailed Dec. 7, 2010.

* cited by examiner

*Primary Examiner* — Stephen D Meier
*Assistant Examiner* — Alexander C Witkowski
(74) *Attorney, Agent, or Firm* — Baker Botts L.L.P.

(57) ABSTRACT

An amount of discrepancy between a theoretical paper feeding length and an actual paper feeding length is determined in advance, and a calibration value is determined based on the amount of discrepancy and stored in a ROM, for each of when a sheet of paper is fed while contacted by a sheet supply roller and when the sheet of paper is fed without contacted by the sheet supply roller. When a printing is performed on a sheet of paper, a feeding amount of the sheet of paper is calibrated based on one of the calibration values stored in the ROM.

24 Claims, 25 Drawing Sheets

FIG.6(a)

| | |
|---|---|
| 1ST MEMORY REGION FOR CALIBRATION VALUE DATA | 90(1) |
| 1ST MEMORY REGION FOR CALIBRATION VALUE DATA | 90(2) |
| 2ND MEMORY REGION FOR SHEET SIZE DATA | 92(1) |
| 2ND MEMORY REGION FOR SHEET SIZE DATA | 92(2) |

FIG.6(b)

MEMORY REGION FOR CALIBRATION VALUE DATA

| FEEDING SECTION | 1 | 2 |
|---|---|---|
| FEEDING CALIBRATION VALUE | A | B |
| MEMORY REGION FOR CALIBRATION VALUE DATA | 90(1) | 90(2) |

FIG.6(c)

DATA STRUCTURE OF CALIBRATION VALUE DATA

| | |
|---|---|
| 1 | A (1ST FEEDING CALIBRATION VALUE) |
| 2 | B (2ND FEEDING CALIBRATION VALUE) |

FIG.6(d)

MEMORY REGION FOR SHEET SIZE DATA

| SHEET SIZE | 1 | 2 |
|---|---|---|
| LONGITUDINAL DIMENSION | a | b |
| MEMORY REGION FOR SHEET SIZE DATA | 92(1) | 92(2) |

FIG.6(e)

DATA STRUCTURE OF SHEET SIZE DATA

| | |
|---|---|
| 1 | A (LENGTH) |
| 2 | B (LENGTH) |

FIG.13(a)

| | |
|---|---|
| MEMORY REGION FOR CALIBRATION DATA | 94a(1) |
| MEMORY REGION FOR CALIBRATION DATA | 94a(2) |
| MEMORY REGION FOR CALIBRATION DATA | 94b(1) |
| MEMORY REGION FOR CALIBRATION DATA | 94b(2) |

FIG.13(b)

MEMORY REGION FOR CALIBRATION DATA

| SHEET TYPE | a | | b | |
|---|---|---|---|---|
| FEEDING SECTION | 1 | 2 | 1 | 2 |
| FEEDING CALIBRATION VALUE | A | B | Y | Z |
| MEMORY REGION FOR SHEET TYPE DATA | 94a(1) | 94a(2) | 94b(1) | 94b(2) |

FIG.13(c)

DATA STRUCTURE OF CALIBRATION DATA

| | | |
|---|---|---|
| a (SHEET TYPE) | 1 (FEEDING SECTION) | A (FEEDING CALIBRATION VALUE) |
| a (SHEET TYPE) | 2 (FEEDING SECTION) | B (FEEDING CALIBRATION VALUE) |
| b (SHEET TYPE) | 1 (FEEDING SECTION) | Y (FEEDING CALIBRATION VALUE) |
| b (SHEET TYPE) | 2 (FEEDING SECTION) | Z (FEEDING CALIBRATION VALUE) |

CONTACT-TIME TEST PATTERN
1ST PATTERN
2ND PATTERN
D1
D2
D3
D4
D5

NON-CONTACT-TIME TEST PATTERN
1ST PATTERN
2ND PATTERN
D1
D2
D3
D4
D5

1ST PATTERN
2ND PATTERN
D1
D2
D3
D4
D5

REFERENCE PATTERN

NOZZLE ROW OF RECORDING HEAD
15a
15a
UPSTREAM PART
15a
15a
15a
DOWNSTREAM PART

| | |
|---|---|
| DISCREPANCY IN 1ST FEEDING SECTION (BETWEEN ORDINARY PAPER AND GLOSSY PAPER) | c |
| DISCREPANCY IN 2ND FEEDING SECTION (BETWEEN ORDINARY PAPER AND GLOSSY PAPER) | d |

CALIBRATION VALUE FOR 1ST FEEDING SECTION FOR GLOSSY PAPER = A + c ··· (1)

CALIBRATION VALUE FOR 2ND FEEDING SECTION FOR GLOSSY PAPER = B + d ··· (2)

FIG.20(a)

| | |
|---|---|
| DISCREPANCY BETWEEN 1ST AND 2ND FEEDING SECTIONS (ORDINARY PAPER) | e |
| DISCREPANCY IN 2ND FEEDING SECTION (BETWEEN ORDINARY PAPER AND GLOSSY PAPER) | f |
| DISCREPANCY BETWEEN 1ST AND 2ND FEEDING SECTIONS (GLOSSY PAPER) | g |

FIG.20(b)

CALIBRATION VALUE FOR 1ST FEEDING SECTION FOR ORDINARY PAPER $= A + e \cdots (3)$ CALIBRATION VALUE FOR 1ST FEEDING SECTION FOR GLOSSY PAPER $= A + f + g \cdots (4)$ CALIBRATION VALUE FOR 2ND FEEDING SECTION FOR GLOSSY PAPER $= A + g \cdots (5)$

FIG.21

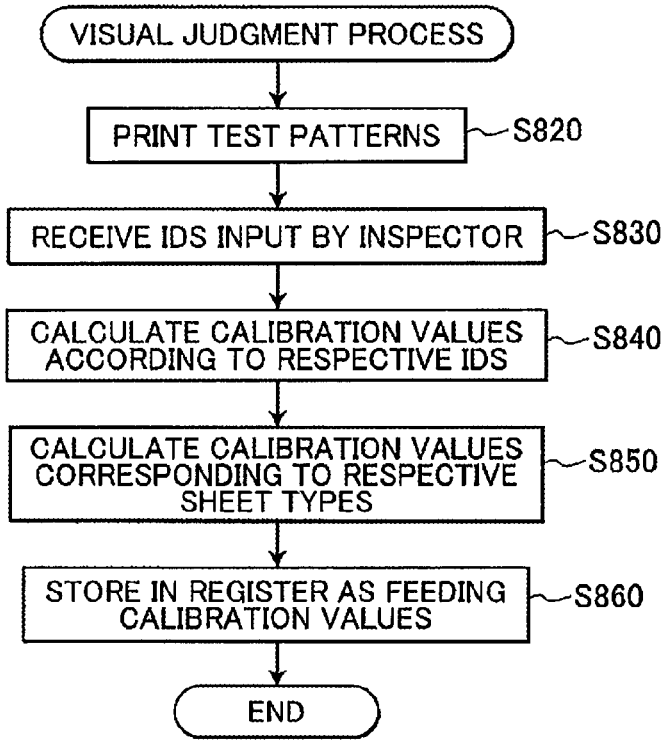

FIG.22(a)

| | |
|---|---|
| MEMORY REGION FOR GLOSSINESS DATA | 96a(1) |
| MEMORY REGION FOR GLOSSINESS DATA | 96a(2) |
| MEMORY REGION FOR GLOSSINESS DATA | 96b(1) |
| MEMORY REGION FOR GLOSSINESS DATA | 96b(2) |

FIG.22(b)

MEMORY REGION FOR GLOSSINESS DATA

| DEGREE OF GLOSSINESS | a | | b | |
|---|---|---|---|---|
| FEEDING SECTION | 1 | 2 | 1 | 2 |
| FEEDING CALIBRATION VALUE | A | B | Y | Z |
| MEMORY REGION FOR GLOSSINESS DATA | 96a(1) | 96a(2) | 96b(1) | 96b(2) |

FIG.22(c)

DATA STRUCTURE OF GLOSSINESS DATA

| | | |
|---|---|---|
| a (DEGREE OF GLOSSINESS) | 1 (FEEDING SECTION) | A (FEEDING CALIBRATION VALUE) |
| a (DEGREE OF GLOSSINESS) | 2 (FEEDING SECTION) | B (FEEDING CALIBRATION VALUE) |
| b (DEGREE OF GLOSSINESS) | 1 (FEEDING SECTION) | Y (FEEDING CALIBRATION VALUE) |
| b (DEGREE OF GLOSSINESS) | 2 (FEEDING SECTION) | Z (FEEDING CALIBRATION VALUE) |

FIG.26(a)

| | |
|---|---|
| MEMORY REGION FOR CASSETTE DATA | 98a(1) |
| MEMORY REGION FOR CASSETTE DATA | 98a(2) |
| MEMORY REGION FOR CASSETTE DATA | 98b(1) |
| MEMORY REGION FOR CASSETTE DATA | 98b(2) |

FIG.26(b)

MEMORY REGION FOR CASSETTE DATA

| SHEET TRAY | a | | b | |
|---|---|---|---|---|
| FEEDING SECTION | 1 | 2 | 1 | 2 |
| FEEDING CALIBRATION VALUE | A | B | Y | Z |
| MEMORY REGION FOR SHEET TRAY DATA | 98a(1) | 98a(2) | 98b(1) | 98b(2) |

FIG.26(c)

DATA STRUCTURE OF CASSETTE DATA

| | | |
|---|---|---|
| a (SHEET TRAY) | 1 (FEEDING SECTION) | A (FEEDING CALIBRATION VALUE) |
| a (SHEET TRAY) | 2 (FEEDING SECTION) | B (FEEDING CALIBRATION VALUE) |
| b (SHEET TRAY) | 1 (FEEDING SECTION) | Y (FEEDING CALIBRATION VALUE) |
| b (SHEET TRAY) | 2 (FEEDING SECTION) | Z (FEEDING CALIBRATION VALUE) |

INKJET RECORDING DEVICE CAPABLE OF CALIBRATING FEEDING AMOUNT OF RECORDING MEDIUM

CROSS REFERENCE TO RELATED APPLICATIONS

This application claims priority from Japanese Patent Application Nos. 2005-380141 and 2005-380144 both filed Dec. 28, 2005. The entire content of each of these priority applications is incorporated herein by reference.

TECHNICAL FIELD

The disclosure relates to an inkjet recording device, and more particularly to a sheet-feeding technique capable of calibrating a feeding amount of a recording medium.

BACKGROUND

There has been known an inkjet recording device that forms images on a recording medium by ejecting ink stored in an ink tank through nozzles of a recording head. A feeding mechanism of this type of inkjet recording device typically includes a sheet feed section capable of accommodating a plurality of sheets of A4 size, for example; a sheet feed roller for feeding the sheets one at a time from the sheet feed section; a feeding roller for feeding the fed sheet to a position below a recording head; a pinch roller disposed in opposition to and pressed against the feeding roller; a discharge roller for discharging the sheet that has been formed with an image onto a discharge section; and a pinch roller (spur) arranged in opposition to and pressed against the discharge roller.

In this type of inkjet printer, a discrepancy between a theoretical paper feeding length of a recording medium and an actual paper feeding length thereof occurs. The theoretical paper feeding length refers to a paper feeding length obtained through calculation.

For example, if the radius of the feeding roller is "r", then the theoretical paper feeding length by one-full rotation of the feeding roller is $2\times\pi\times r$, wherein n is the circular constant. However, the feeding roller actually has the radius of $r\pm\delta$ due to manufacturing error of $\pm\delta$. Thus, the actual paper feeding length by one-full rotation of the feeding roller is $2\times\pi\times(r\pm\delta)$. In other words, there is a difference of $2\times\pi\times(\pm\delta)$ between the theoretical paper feeding length and the actual paper feeding length.

The discrepancy between the theoretical paper feeding length and the actual paper feeding length (hereinafter also referred simply as "discrepancy") is also caused when the recording medium slips on the feeding roller and/or the discharge roller.

Further, the discrepancy occurs due to the backlash of the feeding roller, the discharge roller, and a mechanism, such as a gear coupling mechanism, for coupling a drive source, such as a DC motor, for driving these rollers.

For this reason, the feeding mechanism of the inkjet recording device includes a calibration means for calibrating a feeding amount of recording sheets so as to compensate the discrepancy between the theoretical paper feeding length and the actual paper feeding length (see, Japanese Patent-Application Publication Nos. 2002-254736 and 2001-88377).

SUMMARY

In view of the foregoing, it is an object of the invention to provide a feeding mechanism of an inkjet recording device that can calibrate a feeding amount of recording medium.

In order to attain the above and other objects, the invention provides an inkjet recording device including: a feeding section capable of accommodating a stack of recording medium; a feeding member that separates and feeds the recording medium one at a time from the feeding section; a recording unit including a recording head that ejects ink onto a recording medium and a carriage that reciprocatingly moves in a first direction while mounting the recording head thereon, wherein the recording unit performs printing operation in which the recording head ejects ink onto the recording medium while the carriage is moving in the first direction, and the recording medium has a first section and a second section; a feeding member that feeds the recording medium fed by the feeding member in a second direction substantially perpendicular to the first direction when the recording unit is not performing the printing operation; a detecting unit that detects a paper feeding position as paper feeding; a judgment unit that judges whether the paper feeding position is within the first section or the second section of the recording medium; a controller that controls the recording unit and the feeding member to repeatedly perform the printing operation and the feeding operation in alternation so as to form an image on the recording medium; and a memory that stores a first calibration value corresponding to the first section and a second calibration value corresponding to the second section. The controller controls the feeding member to feed the recording medium while calibration a feeding amount of the recording medium based on the first calibration value when the judgment unit has judged that the paper feeding position is within the first section. The controller controls the feeding member to feed the recording medium while calibrating the feeding amount based on the second calibration value when the judgment unit has judged that the paper feeding position is within the second section.

There is also provided an inkjet recording device including: a feeding section capable of accommodating a stack of recording medium; a feeding member that separates and feeds the recording medium one at a time from the feeding section; a recording unit including a recording head that ejects ink onto the recording medium and a carriage that reciprocatingly moves in a first direction while mounting the recording head thereon, wherein the recording unit performs printing operation in which the recording head ejects ink onto the recording medium while the carriage is moving in the first direction; a feeding member that feeds the recording medium fed by the feeding member in a second direction substantially perpendicular to the first direction when the recording unit is not performing the printing operation; a detecting unit that detects an actual paper feeding length of the recording medium; a controller that controls the feeding member to feed the recording medium; a memory that stores a first calibration value and a second calibration value; and a calculation unit that performs a predetermined calculation. The controller controls the feeding member to feed the recording medium a predetermined distance while calibrating a feeding amount based on the first calibration value. The detecting unit detects the actual feeding amount each time the controller controls the feeding member to feed the recording medium the predetermined distance. The calculation unit calculates a difference between the sum of the actual paper feeding lengths detected by the detecting unit and the sum of the predetermined distances. The controller controls the feeding member to feed the recording medium the predetermined distance while calibrating the feeding amount based on the second calibration value if the difference between the sum of the actual paper feeding lengths and the sum of the predetermined distances exceeds a predetermined value.

There is also provided an inkjet recording device including: a tray that is capable of accommodating a stack of recording medium; a supply roller that separates and supplies the recording medium from the tray one at a time; a recording unit including a recording head that ejects ink onto the recording medium supplied by the supply roller and a carriage that reciprocatingly moves in a first direction while mounting the recording head thereon, wherein the recording unit performs a printing operation where the recording head ejects ink onto the recording medium while the carriage is moving in the first direction; a feed roller that performs a feeding operation to feed the recording medium supplied by the supply roller in a second direction perpendicular to the first direction when the recording unit is not performing the printing operation; a memory that stores a contact-time test pattern and a non-contact-time test pattern; a controller that controls the recording unit and the feed roller to repeatedly perform the printing operation and the feeding operation in alternation so as to form an image on the recording medium, wherein the controller controls the recording unit and the feed roller to perform a test printing where the contact-time test pattern is formed on a first recording medium when the first recording medium is in contact with the supply roller and the non-contact-time test pattern is formed on the first recording medium when the first recording medium is not in contact with the supply roller; a judgment unit that judges appropriateness degrees of the contact-time test pattern and the non-contact-time test pattern formed on the first recording medium; and a calculation unit that calculates a first calibration value based on the appropriateness degree of the contact-time test pattern and a second calibration value based on the appropriateness degree of the non-contact-time test pattern. The memory stores the first and second calibration values calculated by the calculation unit. The controller controls the recording unit and the feed roller to perform a normal printing where an image is formed on a second recording medium. In the normal printing, the feeding operation is performed while calibrating a feeding amount of the second recording medium according to the first calibration value when the second recording medium is in contact with the supply roller and according to the second calibration value when the second recording medium is not in contact with the supply roller.

There is also provided an inkjet recording device including: a tray that is capable of accommodating a stack of recording medium; a supply roller that separates and supplies the recording medium from the tray one at a time; a recording unit including a recording head that ejects ink onto the recording medium supplied by the supply roller and a carriage that reciprocatingly moves in a first direction while mounting the recording head thereon, wherein the recording unit performs a printing operation where the recording head ejects ink onto the recording medium while the carriage is moving in the first direction; a feed roller that performs a feeding operation to feed the recording medium supplied by the supply roller in a second direction perpendicular to the first direction when the recording unit is not performing the printing operation; a memory that stores a test pattern; a controller that controls the recording unit and the feed roller to repeatedly perform the printing operation and the feeding operation in alternation so as to form an image on the recording medium, wherein the controller controls the recording unit and the feed roller to perform a test printing where the test pattern is formed on a first recording medium when the first recording medium is not in contact with the supply roller; a judgment unit that judges an appropriateness degree of the test pattern formed on the first recording medium; and a calculation unit that calculates a first calibration value based on the appropriateness degree of the test pattern. The calculation unit calculates a second calibration value based on the first calibration value. The memory further stores the first and second calibration values calculated by the calculation unit. The controller controls the recording unit and the feed roller to perform a normal printing where an image is formed on a second recording medium while calibrating a feeding amount of the second recording medium according to the second calibration value when the recording medium is in contact with the supply roller and according to the first calibration value when the second recording medium is not in contact with the supply roller.

BRIEF DESCRIPTION OF THE DRAWINGS

Illustrative aspects in accordance with the invention will be described in detail with reference to the following figures wherein:

FIG. 6(*a*) shows memory regions provided to a ROM of the multifunction device in FIG. 1;

FIG. 6(*b*) is a schematic view showing correspondence among feeding sections, feeding calibration values, and the memory regions of the ROM in FIG. 6(*a*);

FIG. 6(*c*) is a schematic view showing the data structure of calibration value data;

FIG. 6(*d*) is a schematic view showing correspondence among sheet sizes, sheet lengths, and the memory regions of the ROM in FIG. 6(*a*);

FIG. 6(*e*) is a schematic view showing the data structure of sheet size data;

FIG. 13(*a*) shows memory regions provided to the ROM according to a third modification;

FIG. 13(*b*) is a schematic view showing correspondence among sheet type, feeding sections, feeding calibration values, and the memory regions of the ROM in FIG. 13(*a*);

FIG. 13(*c*) is a schematic view showing the data structure of calibration data;

FIG. 16(*b*) shows a non-contact-time test pattern for a second feeding section;

FIG. 16(*c*) shows a pattern obtained by printing the contact-time test patter in the second feeding section;

FIG. 16(*d*) shows a reference pattern;

FIG. 16(*e*) shows a row of nozzles provided to a recording head of the multifunction device;

FIG. 17(*a*) shows memory regions provided to the RAM of the multifunction device according to the third modification;

FIG. 17(*b*) shows equations stored in a RAM of the multifunction device according to the third modification;

FIG. 20(*a*) is a schematic view showing memory regions provided to the RAM of the multifunction device according to a fourth modification;

FIG. 20(*b*) shows equation stored in the RAM according to the fourth modification;

FIG. 21 is a flowchart representing a visual judgment process according to a fifth modification;

FIG. 22(*a*) is a schematic view showing memory regions provided to the ROM of the multifunction device according to a sixth modification;

FIG. 22(*b*) shows the correspondence among the glossiness degrees, feeding sections, feeding calibration values, and the memory regions of the ROM;

FIG. 22(*c*) is a schematic view showing the data structure of glossiness data;

FIG. 26(*a*) is a schematic view showing memory regions provided to the ROM of the multifunction device according to the seventh modification;

FIG. 26(*b*) shows the correspondence among sheet cassettes, feeding sections, feeding calibration values, and the memory regions of the ROM;

FIG. 26(*c*) is a schematic view showing the data structure of cassette data;

DETAILED DESCRIPTION

Figure 1:
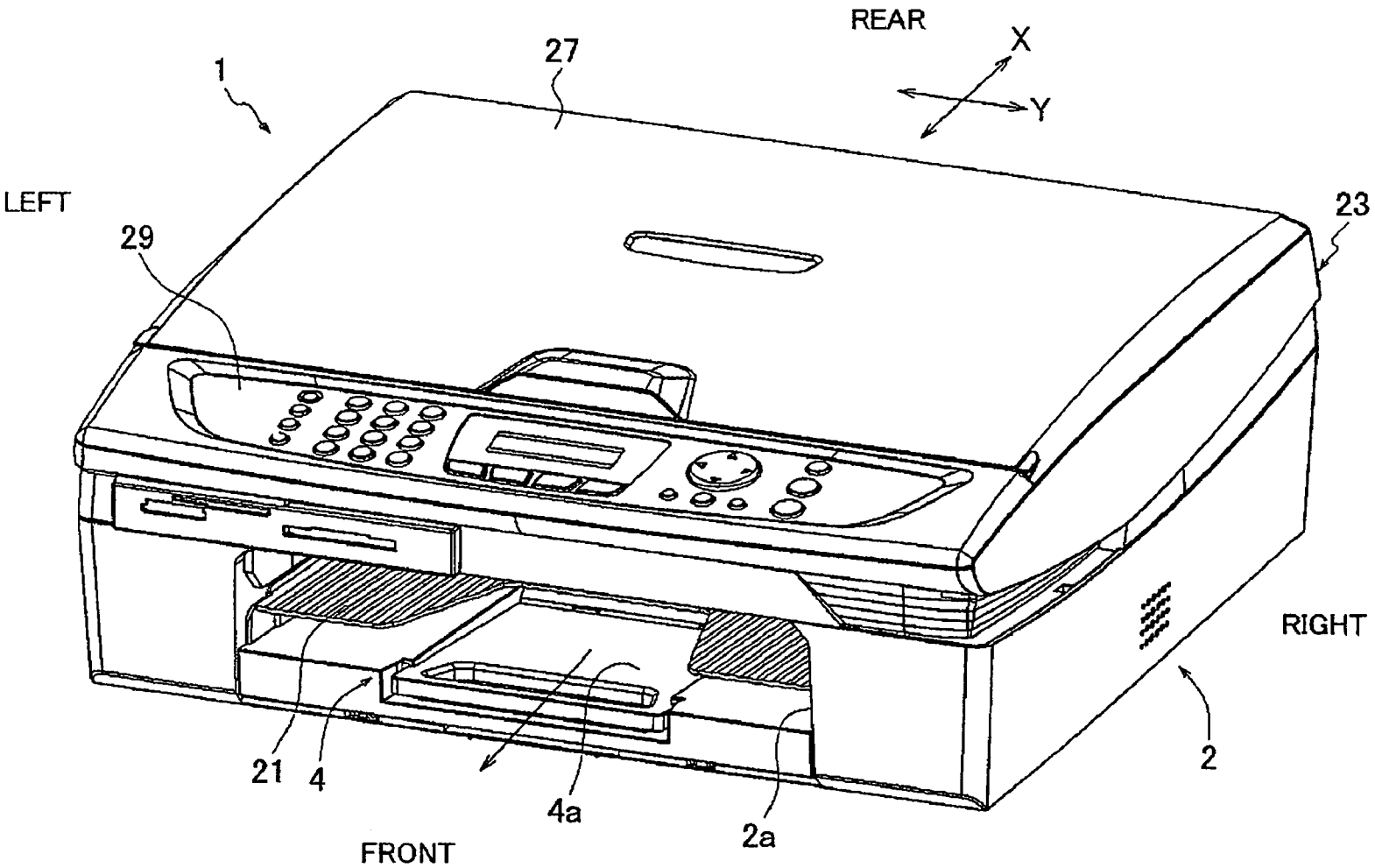
FIG. 1 is a perspective view showing the external configuration of a multifunction device according to some aspects of the invention.

An inkjet recording device according to some aspects of the invention will be described while referring to the accompanying drawings wherein like parts and components are designated by the same reference numerals to avoid duplicating description.

FIG. 1 is a perspective view of a multifunction device 1 to which the inkjet recording device of the invention is applied. The multifunction device 1 has a printing function, a copying function, a scanning function, and a facsimile function. Note that in the following description, the expressions "front", "rear", "left", "right", "above", and "below" are used to define the various parts when the multifunction device 1 is disposed in an orientation in which it is intended to be used.

Figure 2:
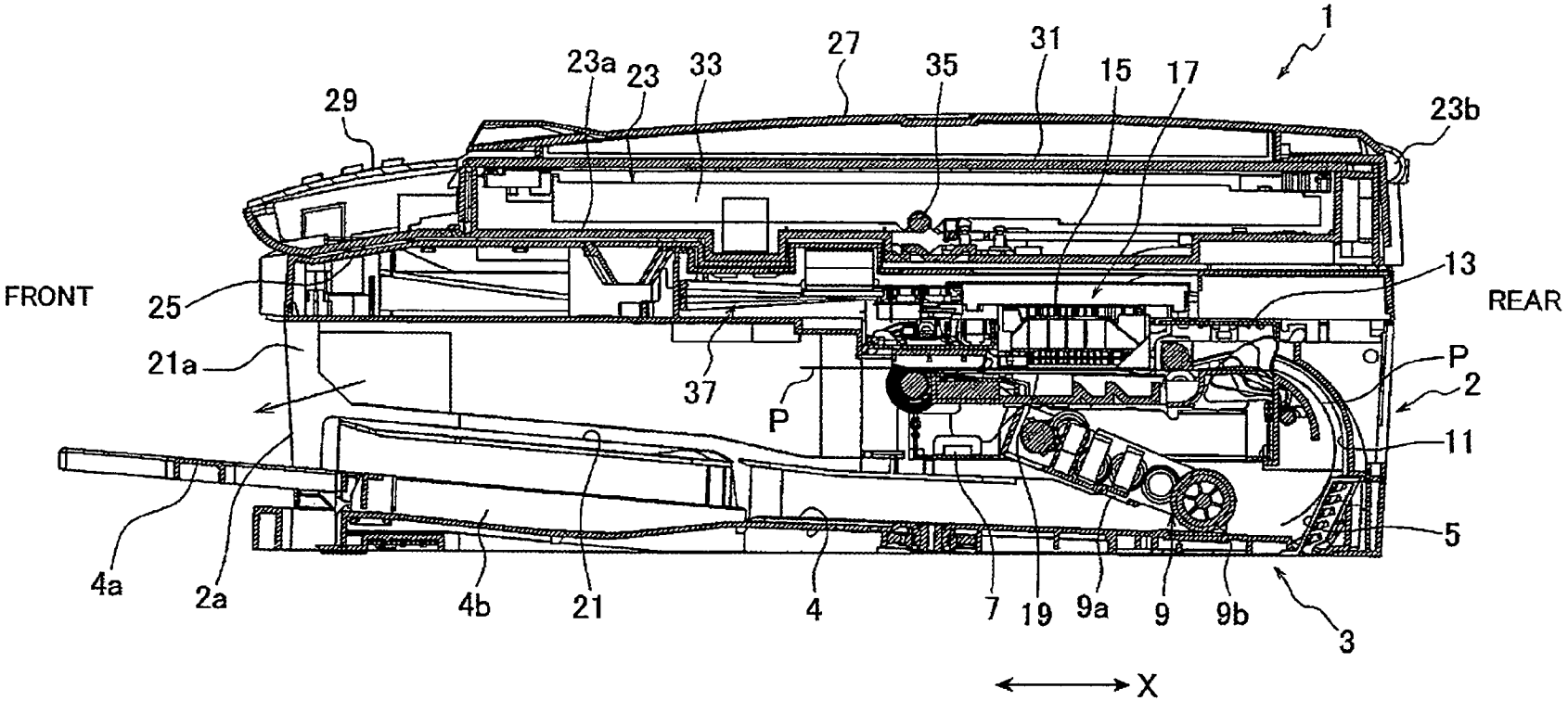
FIG. 2 is a side cross-sectional view of the multifunction device in FIG. 1.

As shown in FIGS. 1 and 2, the multifunction device 1 includes a housing 2 made from a synthetic resin. An opening 2*a* is formed in a front side of the housing 2. An image reader 23 for reading images on an original is disposed on top of the housing 2 such that, as shown in FIG. 2, practically no gap is formed between a bottom wall 23*a* of the image reader 23 and an upper cover 25 of the housing 2.

The image reader 23 is pivotable upward and downward about a shaft (not shown) disposed at an end of the housing 2. The top surface of the image reader 23 is covered by a document cover 27. A rear edge of the document cover 27 is attached to the rear edge of the image reader 23 by hinges 23*b* (FIG. 2) so that the document cover 27 can pivot upward and downward about the hinges 23*b*.

An operation panel 29 is disposed frontward of the image reader 23. The operation panel 29 includes various operation buttons, a liquid crystal display, and the like. As shown in FIG. 2, a glass plate 31 is disposed on the top surface of the image reader 23. An original can be mounted on the glass plate 31 by pivoting the document cover 27 upward. An image scanner 33 is disposed beneath the glass plate 31 for reading images on originals so as to be reciprocatingly movable along a guide shaft 35 extending in a main scanning direction Y.

An inkjet recording unit 3 shown in FIG. 2 is disposed on the housing 2. The inkjet recording unit 3 includes a sheet-feed cassette 4 that can be pulled out of the housing 2 through the opening 2*a*.

The sheet-feed cassette 4 is capable of accommodating a stack of sheets of paper P that have been cut into A4 size, legal size, or the like, such that short sides of the paper P extend parallel to the main scanning direction Y.

An auxiliary support member 4*a* is provided at the front section of the sheet-feed cassette 4 so as to be movable in a sub-scanning direction X perpendicular to the main scanning direction Y. The auxiliary support member 4*a* is for supporting a trailing portion of long sheets of paper P of legal size or the like. Note that FIG. 2 shows the auxiliary support member 4*a* having pulled frontward from the housing 2. However, when images are to be formed on sheets of paper P that can be accommodated within the sheet-feed cassette 4, the auxiliary support member 4*a* can be accommodated in an accommodating section 4*b* formed in the sheet-feed cassette 4 so that the auxiliary support member 4*a* will not be an obstacle to supply the sheets.

As shown in FIG. 2, the multifunction device 1 further includes a bank member 5, a main frame 7, and a sheet supply unit 9. The bank member 5 is provided at a rear end of the sheet-feed cassette 4. The main frame 7 is made of metal plates into a box shape. The sheet supply unit 9 includes a sheet supply arm 9*a* and a sheet supply roller 9*b*. The sheet supply arm 9*a* is fixed to a bottom plate of the main frame 7 so as to be pivotable upward and downward about the front end thereof. The sheet supply roller 9*b* is rotatably supported at the rear end of the sheet supply arm 9*a*. The sheet supply roller 9*b* and the bank member 5 together separate and feed the paper P on the sheet-feed cassette 4 one sheet at a time. The separated paper P is fed to an image forming unit 13 disposed above the sheet-feed cassette 4 by a U-turn path 11.

The image forming unit 13 includes an inkjet recording head 15, a carriage 17 that mounts the recording head 15, and the like. The carriage 17 together with the recording head 15 is reciprocatingly movable in the main scanning direction Y.

During the scanning operation, the recording head 15 ejects ink to form an image on the paper P that is held still on a platen 19 disposed directly below the recording head 15. That is, images are formed on the paper P on the platen 19 by the recording head 15.

Although not shown in the drawings, an ink storage section is disposed in the front section of the housing 2 below the image reader 23. The ink storage section is open on the top so that four ink cartridges can be mounted on and dismounted from the ink storage section from the open top side. Each ink cartridge stores ink of one of four colors (black, cyan, magenta, and yellow). The ink stored in the ink cartridges is supplied to the recording head 15 via a plurality of ink supply tubes 37 that connects between the ink cartridges and the recording head 15.

A discharge tray 21 is disposed above the sheet-feed cassette 4 within a discharge opening 21*a*. A sheet of paper P that has been formed with images at the image forming unit 13 is discharged onto the discharge tray 21. The discharge opening 21*a* is in fluid communication with the opening 2*a*.

Figure 3:
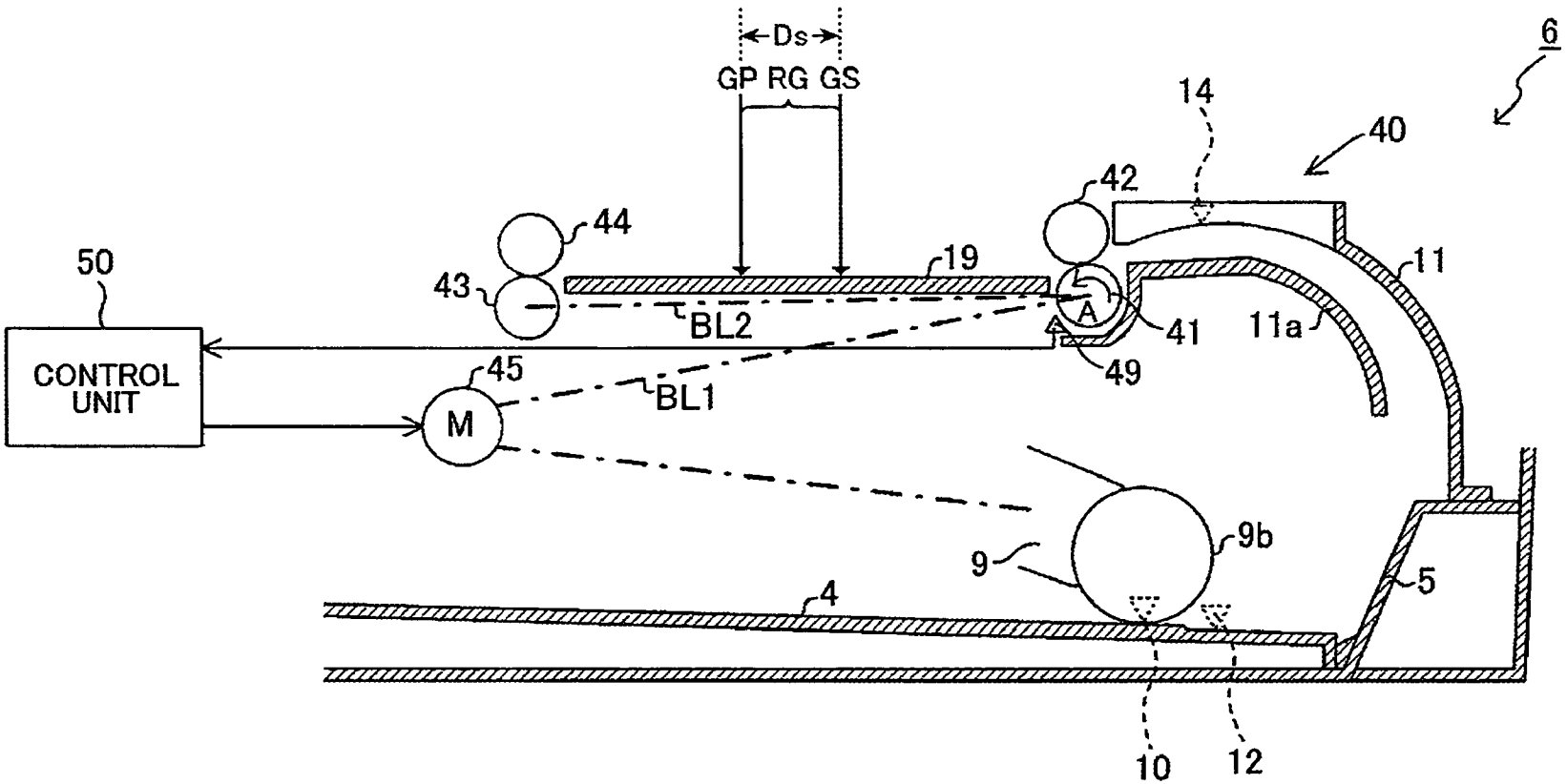
FIG. 3 is a simplified schematic cross-sectional view of a sheet feeding mechanism of the multifunction device in FIG. 1.

The inkjet recording unit 3 further includes a sheet feeding mechanism 6 shown in FIG. 3. The sheet feeding mechanism 6 includes a feeding unit 40 and a control unit 50.

The feeding unit 40 includes the sheet-feed cassette 4, the sheet supply unit 9, a feeding roller 41, a pinch roller 42, a discharge roller 43, a pinch roller (spur) 44, the bank member 5, the U-turn path 11, the platen 19, a sheet feeding motor 45, and belts BL1 and BL2. The feeding roller 41 is for feeding the sheet of paper P fed from the sheet-feed cassette 4 by the sheet supply unit 9. The pinch roller 42 is in pressed contact with the feeding roller 41. The discharge roller 43 is for assisting in the feeding of the paper P during the image formation and also for discharging the paper P to the discharge tray 21 after images has been formed on the paper P. The pinch roller 44 is in pressed contact with the discharge roller 43. The bank member 5, the U-turn path 11, and the platen 19 together form a feeding path of the paper P. The sheet feeding motor 45 is for supplying the feeding roller 41 and the discharge roller 43 with a driving force. The belts BL1 and BL2 are for transmitting the driving force generated by the sheet feeding motor 45. The sheet feeding motor 45 drives based on various instructions (control signals) from the control unit 50.

An upstream part of the sheet feeding path defined by the bank member 5 and the U-turn path 11 restricts the movement of the paper P supplied by the sheet supply roller 9*b* and guides the paper P to a contact point between the feeding roller 41 and the pinch roller 42. An assisting section 11*a* is disposed below a downstream section of the U-turn path 11 in the sheet feeding direction for restricting the downward movement of the paper P and guiding the paper P to the contact point between the feeding roller 41 and the pinch roller 42.

Thus, the paper P supplied from the sheet-feed cassette 4 is guided to the contact point between the feeding roller 41 and the pinch roller 42 by the bank member 5, the U-turn path 11, and the assisting section 11*a*. As the feeding roller 41 is driven to rotate forward (counterclockwise in FIG. 3) in this state, the paper P is drawn and pinched between the feeding roller 41 and the pinch roller 42. Subsequently, the paper P is fed toward the discharge roller 43 along the sheet feeding path the distance corresponding to rotation amount of the feeding roller 41.

The platen 19 defines a part of the sheet feeding path between the feeding roller 41 and the discharge roller 43. In other words, the platen 19 is disposed along a line connecting between the feeding roller 41 and the discharge roller 43. The platen 19 guides the paper P sent out from the feeding roller 41 toward an image forming region RG where an image is formed on the paper P by the recording head 15 with inks of different colors, and then guides the paper P to a contact point between the discharge roller 43 and the pinch roller 44 after an image was formed on the paper P by the recording head 15. In the following description, a downstream end point of the image forming region RG in the sheet feeding direction is referred to as image forming point GP, and an upstream end of the image forming region RG is referred to as a feeding starting point GS.

The paper P is fed toward the discharge roller 43 along the platen 19. When the leading end of the paper P reaches the contact point between the discharge roller 43 and the pinch roller 44, the paper P is drawn and pinched between the discharge roller 43 and the pinch roller 44 by the rotation of the discharge roller 43. Thereafter, the paper P is fed toward the discharge section 21 along the sheet feeding path the distance corresponding to the rotation amount of the discharge roller 43 (which is equal to the rotation amount of the feeding roller 41). Note that the feeding roller 41, the discharge roller 43, and the pinch rollers 42 and 44 rotate about respective shafts extending in the main scanning direction Y substantially perpendicular to the sheet feeding direction. The paper P receives a drive force from the contact point with the feeding roller 41 and the contact point with the discharge roller 43, thereby fed in the paper feeding direction as described above.

The sheet feeding motor 45 is a DC motor that is driven by the control unit 50. The rotational power of the sheet feeding motor 45 is transmitted to the feeding roller 41 by way of the belt BL1 wound on the sheet feeding motor 45 and the feeding roller 41, thereby rotating the feeding roller 41. The rotational power transmitted to the feeding roller 41 is also transmitted to the discharge roller 43 by way of the belt BL2 wound on the feeding roller 41 and the discharge roller 43, thereby rotating the discharge roller 43 in the same direction as the feeding roller 41. The rotational power generated by the sheet feeding motor 45 is also transmitted to the sheet supply roller 9*b* by way of a transmission mechanism (not shown) to drive the sheet supply roller 9*b* to rotate.

Note that the sheet supply roller 9*b* is driven to rotate for feeding the paper P toward the feeding roller 41 only during a sheet supply process, and the roller 9*b* makes idle rotation during an image forming process without receiving the rotational power from the sheet feeding motor 45. In other words, the transmission mechanism linking the sheet supply roller 9*b* to the sheet feeding motor 45 transmits rotational power to the sheet supply roller 9*b* only during the sheet supply process but separates a built-in gear so as not to transmit rotational power to the sheet supply roller 9*b* during the image forming process.

When the sheet supply roller 9*b* rotates forward, the feeding roller 41 and the discharge roller 43 rotate in reverse. In other words, the transmission mechanism linking the sheet supply roller 9*b* to the sheet feeding motor 45 does not transmit rotational power to the sheet supply roller 9*b* when the sheet feeding motor 45 rotates forward, but transmits the rotational power to the sheet supply roller 9*b* after transforming the rotational power in reverse into the forward rotational power by means of the built-in gear when the sheet feeding motor 45 rotates in reverse.

Note that the sheet supply process refers to a process to feed the paper P from the sheet-feed cassette 4 until the leading edge of the paper P reaches a registering position, which is the contact point between the feeding roller 41 and the pinch roller 42, by the rotation of the sheet supply roller 9*b*. The image forming process includes an initial feeding process and a main process. During the initial feeding process, the paper P that has been fed to the registering position is fed until a leading end of an image drawing area on the paper P reaches the image forming point GP. During the main process, the paper P is repeatedly fed a predetermined distance equivalent to a width of the image forming region RG in the sheet feeding direction, such that a reference point of the paper P located at the feeding starting point GS reaches the image forming point GP, and also the recording head 15 forms images on the paper P by ejecting ink in association with the feeding of the paper P. The reference point of the paper P refers to a point of the paper P located at the feeding starting point GS at the time of starting feeding of the paper P, and the reference point of the paper P changes as the paper P is fed.

As described above, during the image forming process, the paper P is repeatedly fed the predetermined distance at a time in the sheet feeding direction (sub-scanning direction X). More specifically, after a single-pass worth of image is formed on the paper P by the recording head 15 while the recording head 15 reciprocates in the main scanning direction Y one time, the paper P is fed a paper feeding length corresponding to the width of the single-pass worth of image, that is equal to the width Ds of the image forming region RG in the paper feeding direction. Then, a next single-pass worth of image is formed by the recording head 15 while the paper P is maintained still. Subsequently, the paper P is again fed the paper feeding length (=Ds), and then, a subsequent single-pass worth of image is formed by the recording head 15 while the paper P is maintained still. In this manner, the operation of feeding the paper P the predetermined distance is repeated until an entire image is formed on the paper P.

The feeding section 40 is provided with a sheet feed encoder 49 that outputs a pulse signal each time the feeding roller 41 rotates a predetermined amount. The output signal from the sheet feed encoder 49 is input to the control unit 50. As described above, both the feeding roller 41 and the discharge roller 43 are driven to rotate by the sheet feeding motor 45, and the rotation of the sheet feeding motor 45 is also transmitted to the sheet supply roller 9*b*. Therefore, it is possible to detect the amount of rotation of each of the sheet feeding motor 45, the feeding roller 41, the discharge roller 43, and the sheet supply roller 9*b* and also the moving amount (fed distance) of the paper P that is fed by the rollers 41, 43, and 9*b*, by detecting and counting the number of the pulse signals output from the sheet feed encoder 49.

Figure 4:
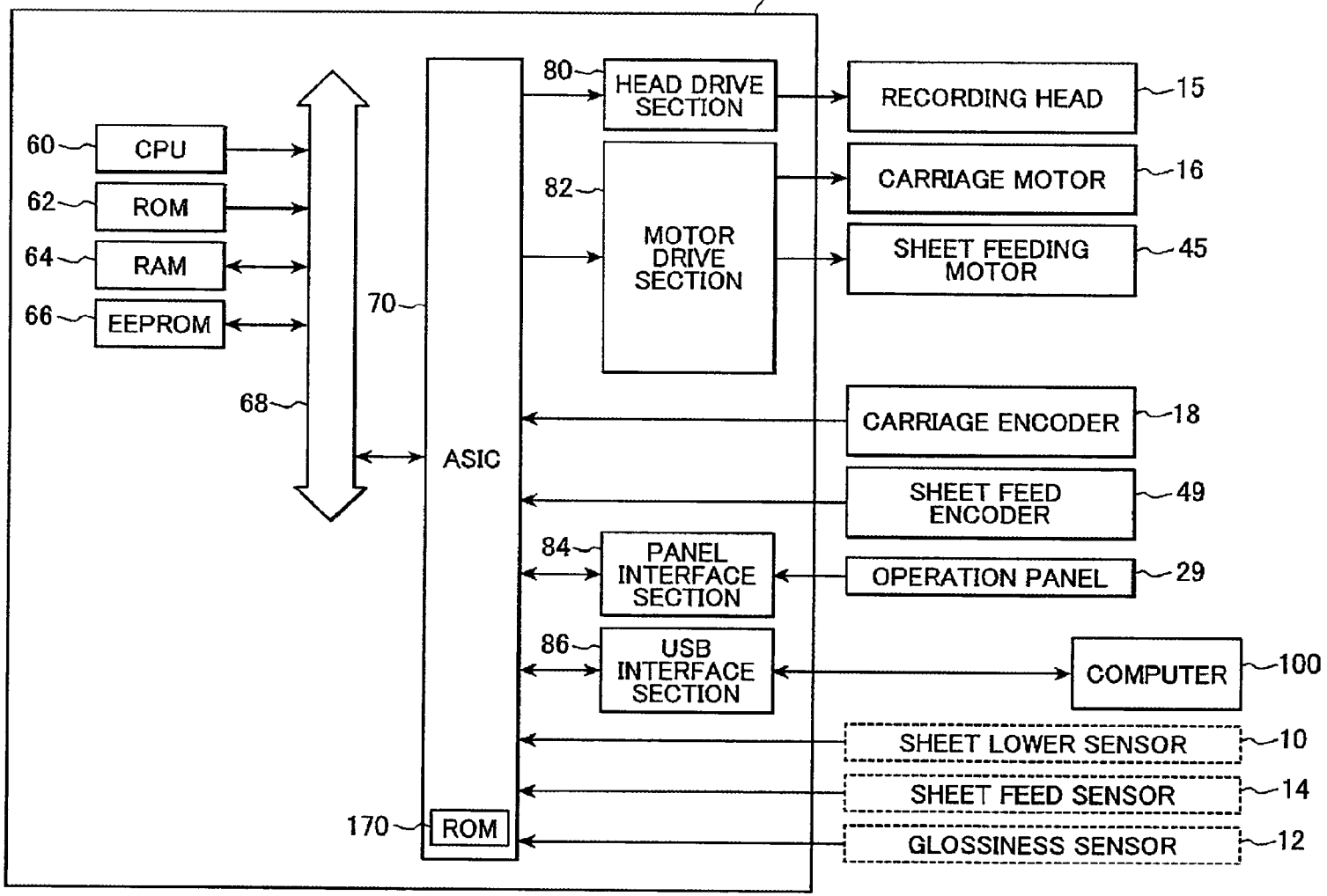
FIG. 4 is a block diagram showing the electrical configuration of the multifunction device in FIG. 1.

Next, the electrical configuration of the inkjet recording unit 3 will be described with reference to FIG. 4. As shown in FIG. 4, the control unit 50 includes a central processing unit (CPU) 60, a read-only memory (ROM) 62, a random-access memory (RAM) 64, an electrically erasable programmable read-only memory (EEPROM) 66, and application specific integrated circuits (ASIC) 70, all connected to each other via a bus 68. The CPU 60 is for performing the overall control of the inkjet recording unit 3.

The control unit 50 also includes a head driving unit 80 for driving the recording head 15 to eject ink, and a motor driving unit 82 for driving a carriage motor 16 and the sheet feeding motor 45. Both the head driving unit 80 and the motor driving unit 82 are connected to the ASIC 70 and controls the driving of the carriage motor 16 and the sheet feeding motor 45. Note that the rotation of the carriage motor 16 moves the carriage 17 in the main scanning direction Y.

The control unit 50 is also provided with a panel interface 84 for processing the signals from the operation panel 29 and a USB interface 86 communicably connected to an external computer 100.

The ASIC 70 is electrically connected to a carriage encoder 18 for detecting the main scanning amount (position) of the cartridge 17 and the sheet feed encoder 49 for detecting the feeding amount (position) of the paper P. The signals from the carriage encoder 18 and the sheet feed encoder 49 are input to the ASIC 70.

With the above-described sheet feeding mechanism 6, there arises a problem of uneven printing due to the difference in the amount of discrepancy between when a sheet of paper P is pressed by the sheet supply roller 9*b* and when the sheet of paper P is not pressed by the sheet supply roller 9*b*.

More specifically, first the uppermost one of sheets stacked in the sheet-feed cassette 4 is separated and fed to the contact point between the feeding roller 41 and the pinch roller 43. When the feeding roller 41 is driven to rotate forward in this state, the sheet is drawn and nipped between the feeding roller 41 and the pinch roller 43. At this time, a trailing part of the sheet is still located and pressed between the sheet supply roller 9*b* and the other sheets remaining in the sheet-feed cassette 4.

As the sheet is fed by the feeding roller 41 and the pinch roller 43 in this condition, the trailing section of the sheet is subjected to feeding resistance by a function between the sheet and the remaining sheets because the trailing section of the sheet is pressed between the sheet supply roller 9*b* and the remaining sheets. When the trailing section of the sheet is subjected to such feeding resistance, the sheet can slip under the feeding roller 41, leading to a large discrepancy.

After the sheet is fed further, the trailing section of the sheet is released from the sheet supply roller 9*b*, and thus the trailing section of the sheet is released from the feeding resistance due to the friction between the sheet and the other sheets. Because the trailing section of the sheet is no longer subjected to the feeding resistance in this condition, the sheet does not slip under the feeding roller 41. As a result, the amount of discrepancy becomes smaller.

In this way, the feeding resistance exerted on the paper P varies depending on the position of the paper P, and thus the amount of discrepancy varies depending on the position of the paper P.

Thus, the feeding amount is calibrated depending on the amount of discrepancy that differs depending on the position of the sheet of paper P, as described next.

Figure 5:
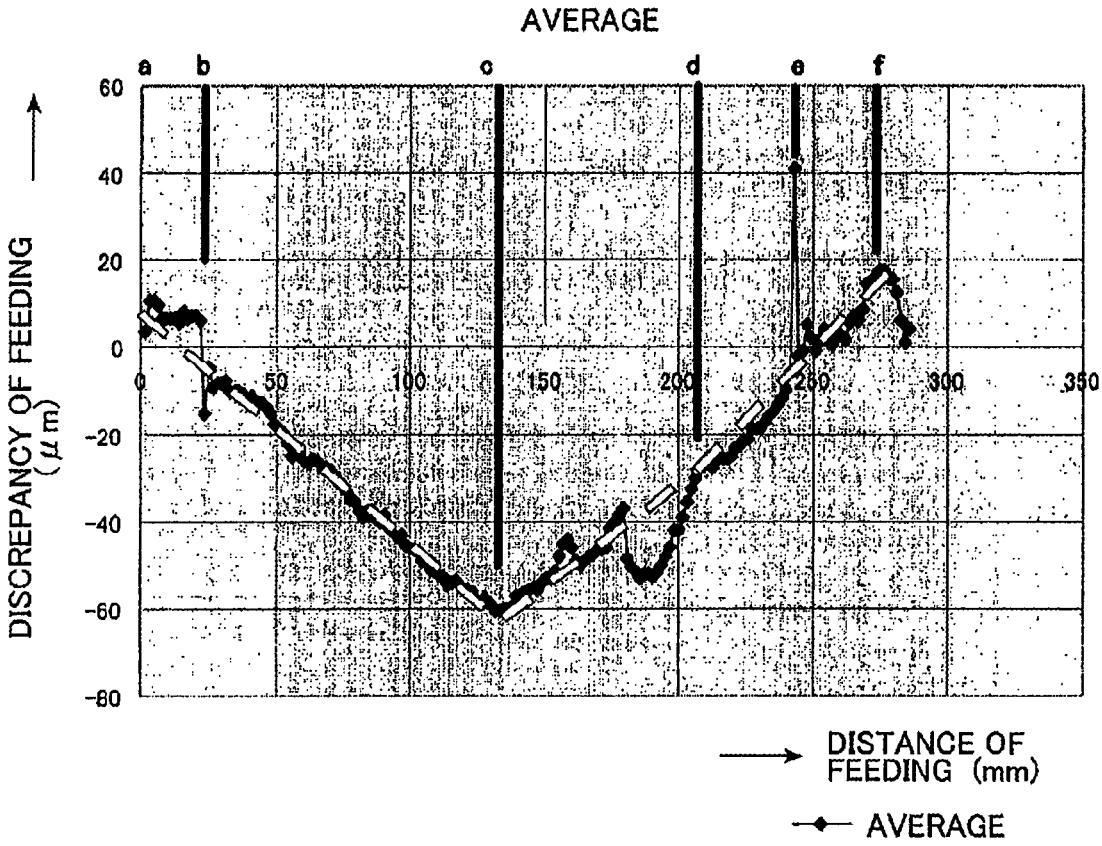
FIG. 5 is a graph illustrating an amount of discrepancy between a theoretical paper feeding length and an actual paper feeding length.

As shown in FIG. 5, the amount of discrepancy between a theoretical feeding amount and an actual feeding amount is determined in advance both for a feeding section where the paper P is fed while being pressed by the sheet supply roller 9*b* (between "a" and "c" in FIG. 5) (hereinafter referred to as "first feeding section") and for a feeding section where the paper P is fed without pressed by the sheet supply roller 9*b* (between "c" and "f" in FIG. 5) (hereinafter referred to as "second feeding section").

FIG. 5 is a graph showing the amount of discrepancy between the theoretical paper feeding length and the actual paper feeding length when an A4-size sheet is fed in the longitudinal direction thereof. In FIG. 5, the horizontal axis indicates the paper feeding length of the A4-size sheet. In other words, the horizontal axis indicates the distance from the leading edge of the sheet to the position of the sheet supply roller 9*b*. The vertical axis indicates the amount of discrepancy between the theoretical paper feeding length and the actual paper feeding length. The determined results are indicated by the rhombuses in FIG. 5. For example, the amount of discrepancy is about 7 μm when the A4-sized sheet has been fed about 20 mm ("b" in FIG. 5), and the amount of discrepancy is about −60 μm when the A4-sized sheet has been fed about 130 mm ("c" in FIG. 5). Note that the negative sign "−" preceding a value indicates that the actual paper feeding length is smaller than the theoretical paper feeding length.

That is, as seen from FIG. 5, the amount of discrepancy increases in the negative direction "−", from the position "b" to the position "c", substantially in proportion to the paper feeding length, and reaches the maximum value of about −60 μm at the position "c". On the other hand, the amount of discrepancy is about 20 μm at the position of about 280 mm ("f" in FIG. 5). The positive sign "+" preceding a value indicates that the actual paper feeding length is larger than the theoretical paper feeding length. That is, as seen from FIG. 5, the amount of discrepancy increases in the positive direction "+" from the position "c" to the position "f", substantially in proportion to the paper feeding length.

Because the actual paper feeding length is smaller than the theoretical paper feeding length from the position "b" to the position "c" in FIG. 5, the feeding amount can be calibrated by increasing the same (in other words, by increasing in a positive direction). For example, the distance from the position "b" to the position "c" in FIG. 5 is "about 130 mm−about 20 mm=about 110 mm" and the amount of discrepancy is "about −60 μm−(about −5 μm)=about −55 μm". Therefore, calibration can be performed by adding a calibration amount of about +55 μm for the paper feeding length of 110 mm.

On the other hand, because the actual paper feeding length is larger than the theoretical paper feeding length from the position "c" to the position "f" in FIG. 5, the feeding amount can be calibrated by decreasing the same (in other words, by increasing in a negative direction). For example, a distance from the position "c" to the position "f" in FIG. 5 is "about 280 mm−about 130 mm=about 150 mm" and the amount of discrepancy is "about 20 μm−(about −60 μm)=about +80 μm". Therefore, calibration can be performed by adding a calibration amount of about −80 μm for the distance of 150 mm.

As shown in FIG. 6(*a*), the ROM 62 has first memory regions 90(1) and 90(2) for calibration value data and second memory regions 92(1) and 92(2) for sheet size data.

As shown in FIGS. 6(*b*) and 6(*c*), the calibration value data indicates the correspondence between the feeding sections of paper P and calibration values. More specifically, a value of "1" indicating the first feeding section is stored in the first memory region 90(1) in association with a first feeding calibration value of "A". Similarly, a value of "2" indicating the section feeding section is stored in the first memory region 90(2) in association with a second feeding calibration value of "B".

Note that each calibration value is determined in advance by adding the calibration amount that has been determined based on the amount of discrepancy to the actual paper feeding length.

As shown in FIGS. 6(*d*) and 6(*e*), the sheet size data indicates the correspondence between the size of a sheet of paper P and the length of the sheet. More specifically, a value of "1" indicating a first sheet size is stored as first sheet size data in the second memory region 92(1) in association with sheet length data "a" indicating the length of the same. Similarly, a value of "2" indicating a second sheet size is stored as a second sheet size data in the second memory region 92(2) in association with sheet length data "b" indicating the length of the same. For example, assuming that a paper is fed in its longitudinal direction, the length of a A4-size sheet is 297 mm, and the length of a A3-size sheet is 420 mm.

Figure 7:
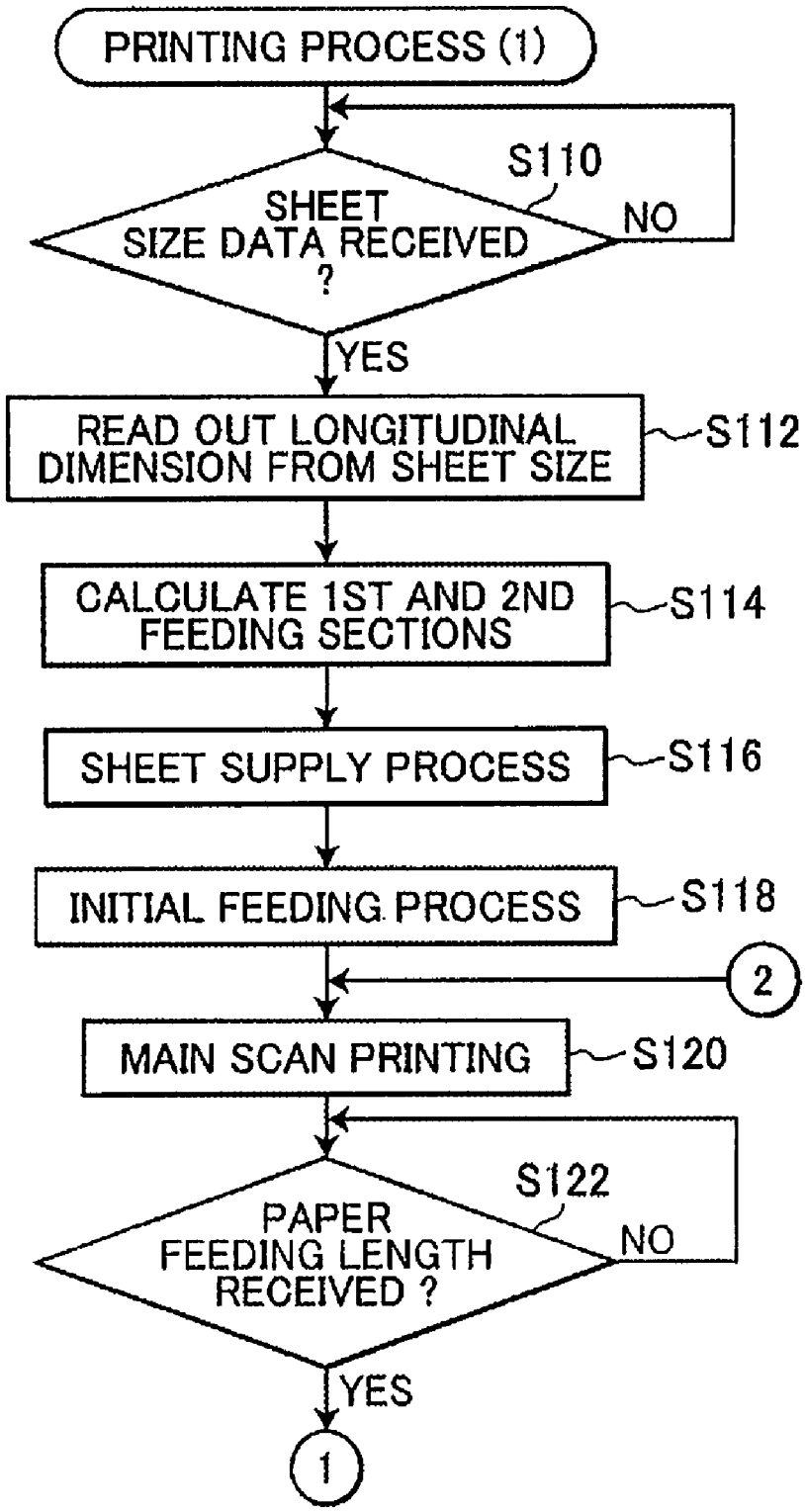
FIG. 7 is a flowchart representing a former half of a printing process (1) executed in the multifunction device in FIG. 1.
Figure 8:
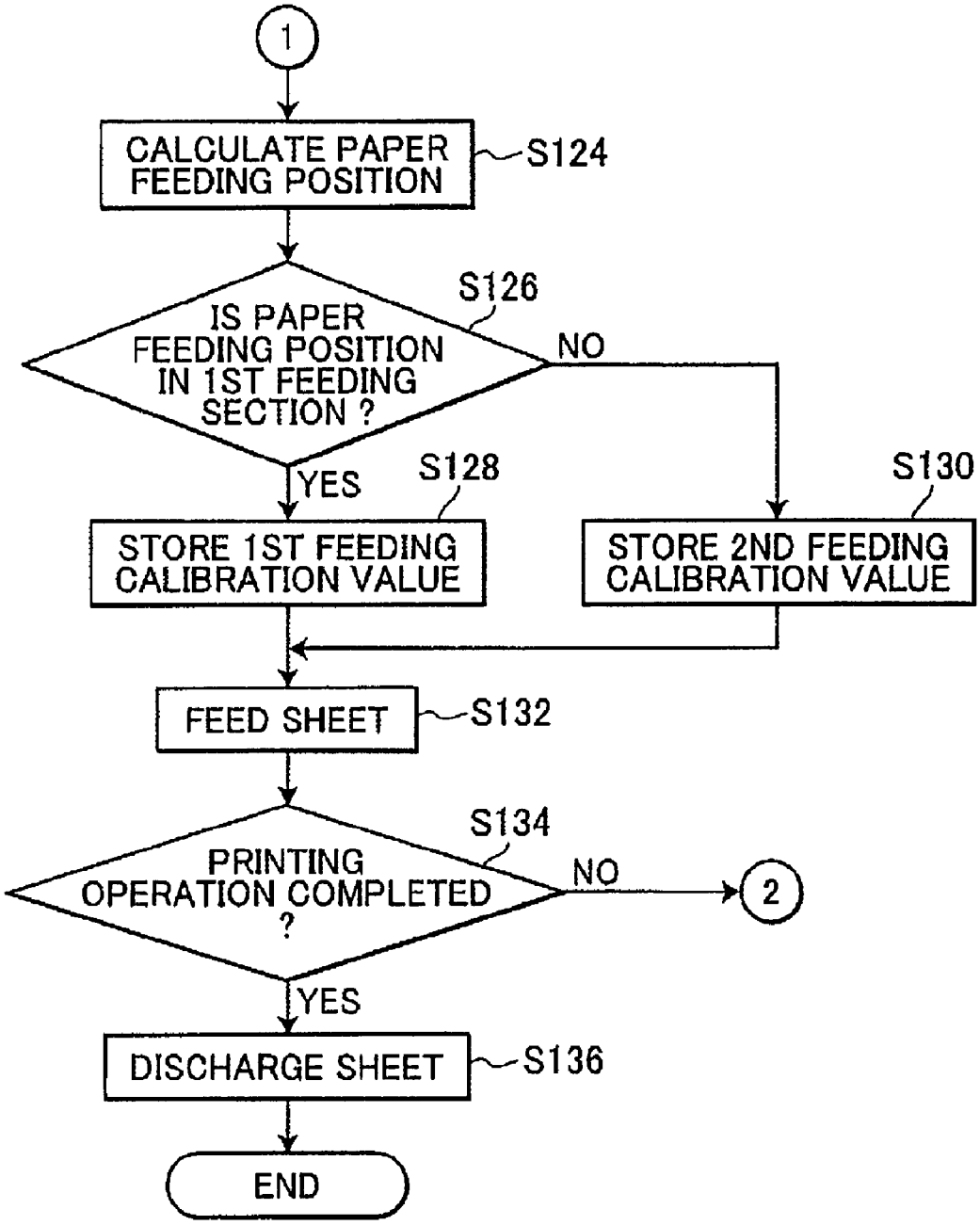
FIG. 8 is a flowchart representing a latter half of the printing process (1)

Next, a printing process (1) that is executed by the CPU 60 will be described below with reference to flowcharts of FIGS. 7 and 8. The printing process (1) is executed for printing images on a sheet of paper P while calibrating the feeding amount of the paper P.

In the printing process (1), it is first determined in S110 whether or not sheet size data is received. Note that the sheet size data inputted through the computer 100 is transmitted from the computer 100 to the control unit 50 by way of the USB interface 86. On the other hand, when the sheet size data is inputted through the operation panel 29, the sheet size data is transmitted to the CPU 60 by the panel interface 84.

If it is determined in S110 that the sheet size data is not received (S110: NO), the process waits until the sheet size data is received. On the other hand, if it is determined that the sheet size data is received (S110: YES), then the sheet length data corresponding to the received sheet size data is retrieved from the second memory region 92 (S112), and the process proceeds to S114.

In S114, the length of the first feeding section and that of the second feeding section are determined based on the sheet length data retrieved in S112. Here, the length of the first feeding section can be determined by subtracting the length of the second feeding section from the length of the paper P.

In this aspect, the length of the second feeding section is defined to be the length from a trailing edge of paper P to a position of the paper P located at the image forming point GP at the time of when the paper P is freed from the pressure applied by the sheet supply roller 9*b*. In other words, the second feeding section of the paper P is a section that reaches the image forming point GP without the paper P is contacted by the sheet supply roller 9*b*, and the length of the second feeding section is equal to the distance between the sheet supply roller 9*b* to the image forming position GP in the sheet feeding direction. Thus, the length of the second feeding section of paper P is the same regardless of the total length of the paper P, but the length of the first feeding section varies depending on the total length of the paper P. The first feeding section is a leading section of the paper P in the sheet feeding direction, whereas the second feeding section is a trailing section in the sheet feeding direction. For example, assuming that a paper P is fed in its longitudinal direction, the length of an A3-size sheet of paper P is 420 mm, and the length of an A4-size sheet of paper P is 297 mm. If the length of the second feeding section is 100 mm for both the A3-size sheet and the A4-size sheet, the length of the first feeding section is determined to be 420 mm−100 mm=320 mm for the A3-size sheet and 297 mm−100 mm=197 mm for the A4-size sheet.

Then, in S116, the CPU 60 executes the sheet supply process. More specifically, under the control of CPU 60, the ASIC 70 controls the motor drive section 82 such that the motor drive section 80 drives the sheet supply roller 9*b* to rotate while the sheet supply roller 9*b* is in pressed contact with the uppermost one of the sheets of paper P stacked on the sheet-feed cassette 4, and the uppermost sheet of paper P is fed in the sheet feeding direction until the leading edge of the paper P reaches the registering position between the feeding roller 41 and the pinch roller 42.

Then, in S118, the initial feeding process is executed. More specifically, under the control of the CPU 60, the ASIC 70 controls the motor drive section 82 such that the feeding roller 41 feeds the paper P supplied to the registration position until a leading end of an image forming area on the paper P reaches the image forming point GP.

Subsequently, in S120, a main scan printing is executed. More specifically, under the control of the CPU 60, the ASIC 70 controls the head drive section 80, such that the head drive section 80 controls the recording head 15 to eject ink to form an image on the paper P.

Then, in S122, the CPU 60 determines whether or not the paper feeding length of the paper P has been received from the computer 100 by way of the USB interface 86. As described above, the paper feeding length of the paper P refers to the distance which the paper P is fed until the reference position of the paper P located at the feeding starting point GS reaches the image forming point GP.

If a positive determination is made in S122 (S122: YES), then a paper feeding position is determined (S124). The determination of the paper feeding position can be performed by adding up the length the paper P has been fed in the initial feeding process of S118 and the paper feeding length acquired in S122. For example, when the length the paper P is fed in S118 is Di and the paper feeding length of the paper P is fixed to Ds, after the paper feeding length is received in S122 first time after the initial feeding process of S118, then the paper feeding position is determined to be Di+Ds×1=Di+Ds in S124. After the paper feeding length is received in S122 the second time, the paper feeding position is determined to be Ds×2=2Ds in S124. Similarly, after the paper feeding length is received the $n^{th}$ time, the paper feeding position is determined to be Di+Ds×n=Di+n×Ds.

Then, in S126, the CPU 60 determines whether or not paper feeding position determined in S124 is in the first feeding section based on the length of the first feeding section that was determined in S114. If so (S126: YES), then in S128, the CPU 60 retrieves the first feeding calibration value that corresponds to the first feeding section from the calibration value data stored in the ROM 62, and controls the ASIC 70 to store the retrieved first feeding calibration value into the ROM 170 (FIG. 4) of the ASIC 70. Subsequently, the process proceeds to S132. On the other hand, if not (S126: NO), then in S130, the CPU 60 retrieves the second feeding calibration value that corresponds to the second feeding section from the calibration value data stored in the ROM 62, and controls the ASIC 70 to store the retrieved second calibration value into the ROM 170. Thereafter, the process proceeds to S132.

In S132, the CPU 60 controls the ASIC 70 to feed the paper P the paper feeding length received in S122 by using the feeding calibration value retrieved in S128 or in S130. More specifically, under the control of CPU 60, the ASIC 70 retrieves the feeding calibration value stored in the ROM 170 and controls the motor drive section 82 to feed the paper P the paper feeding length received in S122 based on the retrieved feeding calibration value.

Then, in S134, the CPU 60 determines whether or not a printing operation has completed. If not (S134: NO), then the process returns to S120. On the other hand, if so (S134: YES), then in S136, the CPU 60 controls the ASIC 70 to execute a discharge process (S136). More specifically, the ASIC 70 controls the motor drive section 82 to drive the feeding roller 41 and the discharge roller 43 to rotate, thereby discharging the paper P to the discharge section 21. Then, the current process ends.

As described above, the amount of discrepancy for the first feeding section of the paper P (for when the paper P is pressed by the sheet supply roller 9*b*) and the amount of discrepancy for the second feeding section (for when the paper P is not pressed by the sheet supply roller 9*b*) are determined in advance and stored as the feeding calibration values in the ROM 62. Also, even if the sheets of paper P have a different length, the CPU 60 can determine whether or not the paper P is being contacted by the sheet supply roller 9*b*, by calculating the paper feeding position of the paper P, and the CPU 60 retrieves an appropriate feeding calibration value from the ROM 62 and controls the ASIC 70 to feed the paper P according to the retrieved feeding calibration value.

Therefore, while the length in the paper feeding direction varies among the sheets of paper P, the feeding amount of paper P can be calibrated for both the first and second feeding sections in an appropriate manner, so that uneven printing can be prevented.

While the invention has been described in detail with reference to the above aspects thereof, it would be apparent to those skilled in the art that various changes and modifications may be made therein without departing from the spirit of the invention.

(First Modification)

For example, in the above-described aspect, the CPU 60 determines whether the paper P is being contacted by the sheet supply roller 9*b* through calculation. However, it is possible to detect whether or not the paper P is being contacted by the sheet supply roller 9*b* using a sheet lower sensor.

More specifically, as indicated by broken lines in FIG. 3, a sheet lower sensor 10 may be disposed along a single line as a plane with the sheet supply roller 9*b* at a position where the sheet supply roller 9*b* contacts the paper P such that the sensor 10 can detect the paper P. As shown in FIG. 4, the sheet lower sensor 10 is electrically connected to the ASIC 70 so that signals from the sheet lower sensor 10 are input to the ASIC 70. The sheet lower sensor 10 is a laser type displacement sensor, for example, that detects a step produced at the trailing edge of the paper P due to the thickness of the paper P. For example, since a sheet of plane paper P typically has a thickness of about 90 μm, the step at the trailing edge of the paper P can be detected by a laser type displacement sensor having a resolution of about 10 μm.

Figure 9:
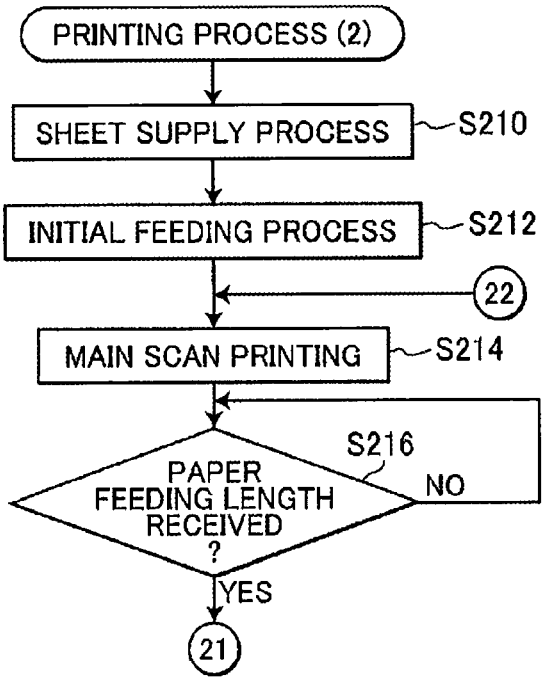
FIG. 9 is a flowchart representing a former half of a printing process (2) according to a first modification.
Figure 10:
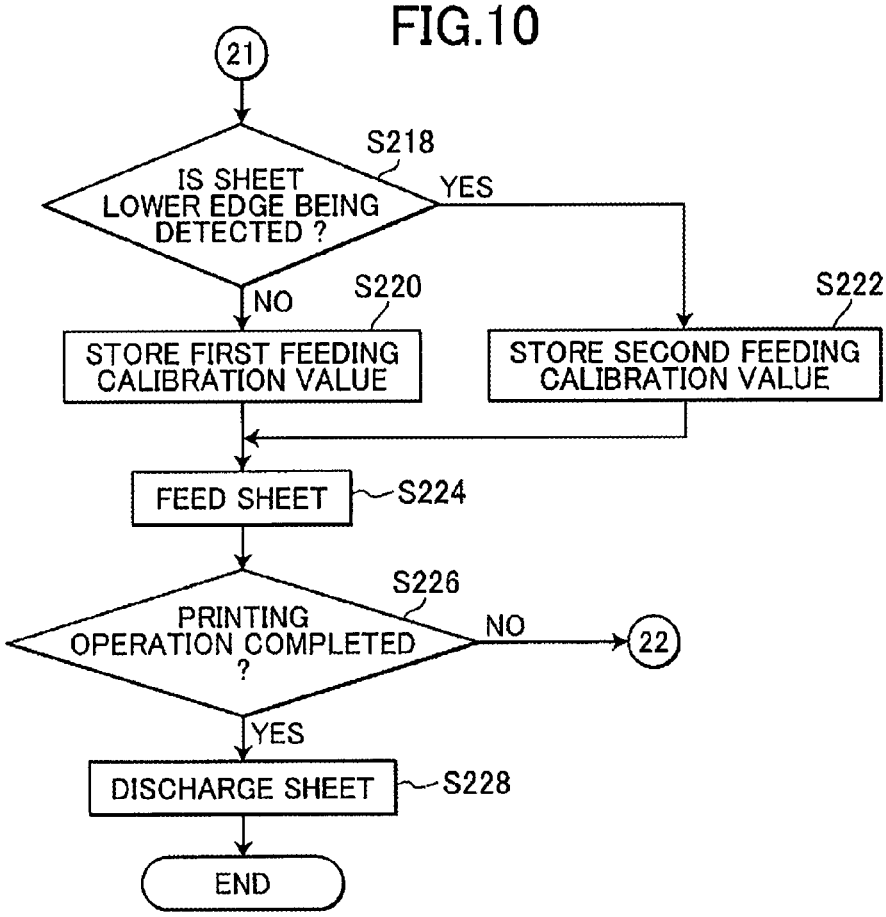
FIG. 10 is a flowchart representing a latter half of the printing process (2)

In this case, a printing process (2) shown in FIGS. 9 and 10 is executed by the CPU 60, instead of the above-described printing process (1).

In the printing process (2), first the CPU 60 executes the sheet supply process in S210 and then the initial feeding process in S212. Subsequently, the CPU 60 executes the main scan printing in S214 and determines in S216 whether or not the paper feeding length is received from the computer 100. Since the processes in S210 through S216 are the same as those in S116 through S122 of the above-described printing process (1), detailed description of the same will be omitted.

If a positive determination is made in S216 (S216: YES), then in S218, the CPU 60 determines whether or not the sheet lower sensor 10 has detected the trailing edge of a paper P (that is, the step produced at the trailing edge of the paper P due to the thickness thereof). If not (S218: NO), then in S220, the CPU 60 retrieves the first feeding calibration value and stores the same in the ROM 170 in the same manner as in S128. Then, the process proceeds to S224. On the other hand, if so (S218: YES), then in S222, the CPU 60 retrieves the second feeding calibration value and stores the same in the ROM 170 in the same manner as in S130. Then, the process proceeds to S224.

Since the processes in S224 through S228 are the same as those in S132 through S136 of the above-described printing process (1), detailed description thereof will be omitted.

According to this modification, the sheet lower sensor 10 detects the trailing edge of the paper P in the above-described manner. Thus, it is possible to determine whether or not the paper P is being pressed by the sheet supply roller 9*b* even if the paper P has a different length, without receiving the sheet size data from the computer 100. Thus, in this case also, uneven printing can be prevented.

(Second Modification)

In the above-described printing process (1), the CPU 60 determines the lengths of the first and second feeding sections based on the total length of the paper P. However, it is possible determine whether or not the paper P is being pressed by the sheet supply roller 9*b* by detecting a point of change in the amount of discrepancy.

Specifically, as indicated by broken lines in FIG. 3, a sheet feed sensor 14 is disposed between the sheet supply roller 9*b* and the feeding roller 41 in the sheet feeding direction. The sheet feed sensor 14 includes a roller (not shown) that is driven to rotate while being in contact with the paper F and a rotary encoder (not shown) that outputs a pulse signal each time the roller rotates a predetermined amount. The sheet feed sensor 14 can directly detect a feeding amount of the paper P. As shown in FIG. 4, the sheet feed sensor 14 is electrically connected to the ASIC 70 so that signals from the sheet feed sensor 14 are input to the ASIC 70. Note that instead of the rotary encoder, the sheet feed sensor 14 may include an image sensor, for example, that detects the feeding amount of the paper P by detecting a surface pattern of the paper P and a movement of the surface pattern.

The ROM 62 stores calibration mode data that indicates the correspondence among first and second calibration modes and the first and second feeding calibration values.

Figure 11:
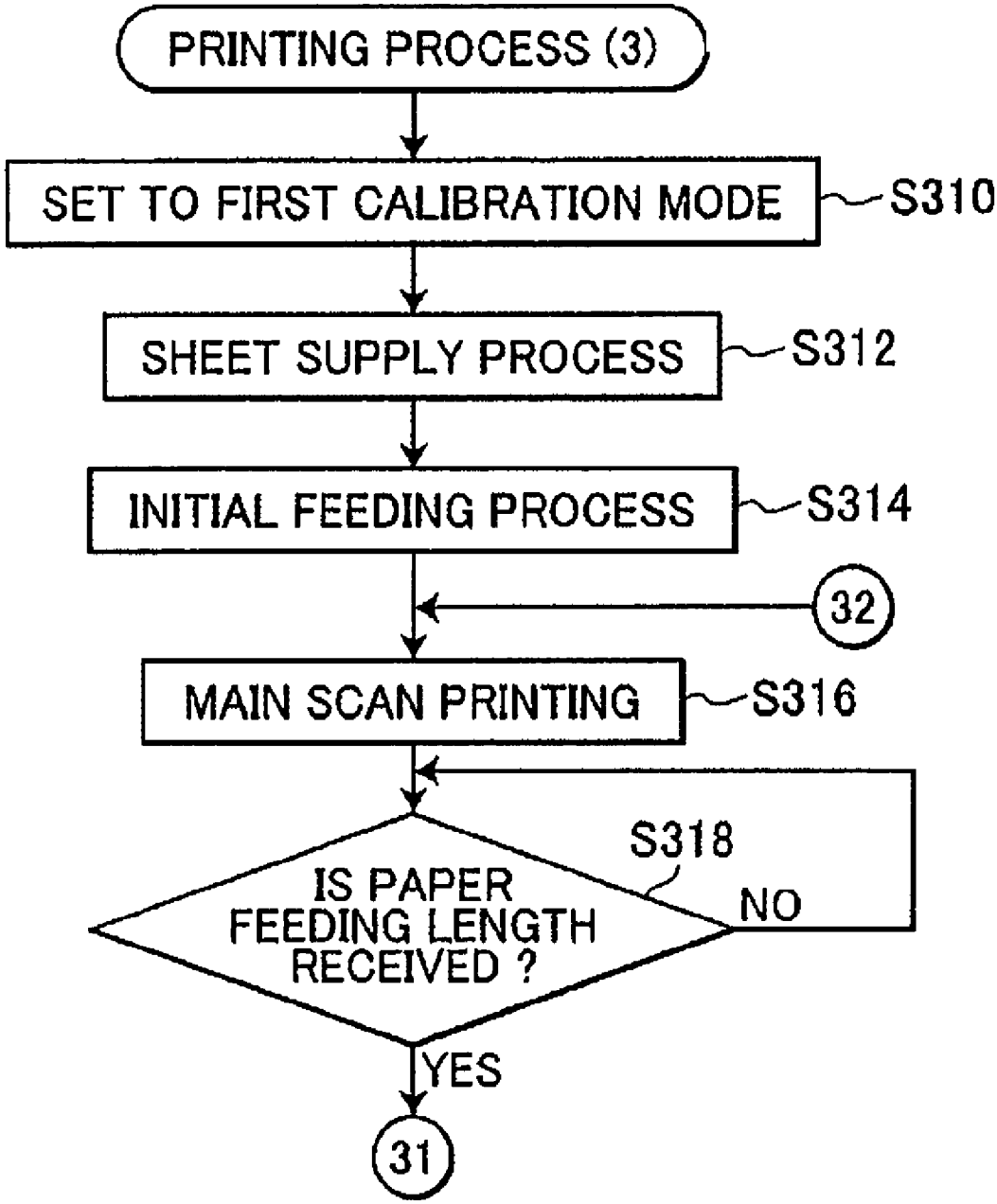
FIG. 11 is a flowchart representing a former half of a printing process (3) according to a second modification.
Figure 12:
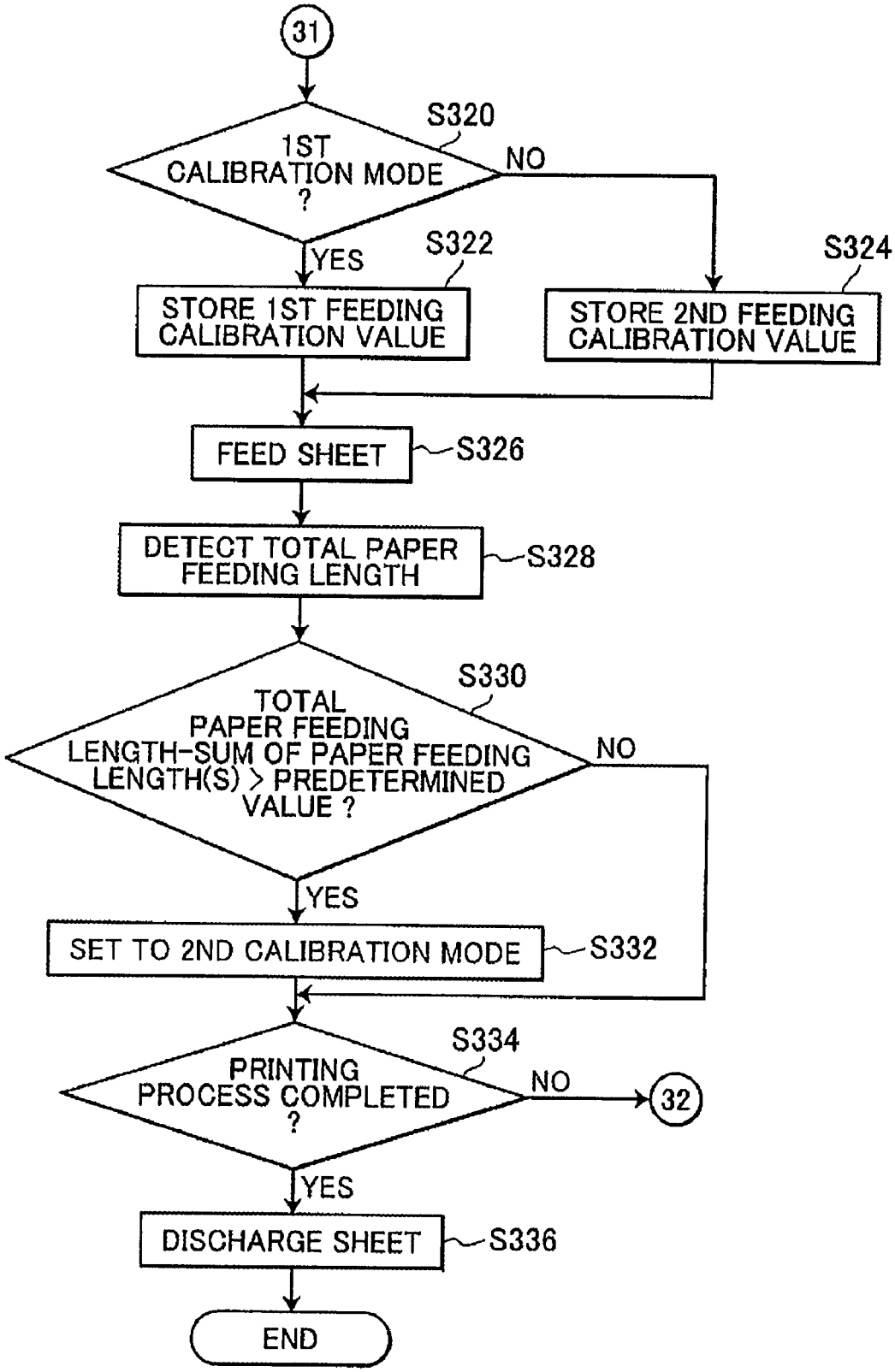
FIG. 12 is a flowchart representing a latter half of the printing process (3)

In this case, a printing process (3) shown in FIGS. 11 and 12 is executed by the CPU 60, in stead of the above-described printing process (1). In the printing process (3), first in S310, the CPU 60 set a calibration mode to the first calibration mode. More specifically, the CPU 60 retrieves the first feeding calibration value corresponding to the first calibration mode from the calibration mode data stored in the ROM 62 and controls the ASIC 70 to store the retrieved first feeding calibration value in the ROM 170.

Then, the CPU 60 executes the sheet supply process in S312 and the initial feeding process in S314. Thereafter, the CPU 60 executes the main scan printing in S316 and determines in S318 whether or not the paper feeding length has been received from the computer 100. Since the processes in S312 through S318 are the same as those in S116 through S122 of the above-described printing process (1), detailed description thereof will be omitted.

If a positive determination is made in S318 (S318: YES), then the CPU 60 determines in S320 whether or not the calibration mode is the first calibration mode. More specifically, the CPU 60 controls the ASIC 70 to retrieve the feeding calibration value stored in the ROM 170, retrieves the calibration mode that corresponds to the retrieved feeding calibration value from the calibration mode data stored in the ROM 62, and determines whether or not the retrieved calibration mode is the first calibration mode. If the calibration mode is the first calibration mode (S320: YES), then in S322, the CPU 60 controls the ASIC 70 to store the first feeding calibration value into the ROM 170. Then, the process proceeds to S326.

On the other hand, if the calibration mode is not the first calibration mode (S320: NO), then in S324, the CPU 60 retrieves the second feeding calibration value that corresponds to the second calibration mode from the calibration mode data stored in the ROM 62 and controls the ASIC 70 to store the retrieved second feeding calibration value in the ROM 170. Then, the process proceeds to S326.

In S326, the CPU 60 controls the ASIC 70 to feed the paper P the paper feeding length received in S318 by using the feeding calibration value stored in ROM 170. More specifically, under the control of the CPU 60, the ASIC 70 retrieves the feeding calibration value from the ROM 170 and controls the motor drive section 82 to feed the paper P the paper feeding length received in S318 based on the retrieved feeding calibration value. Then, the process proceeds to S328.

In S328, the CPU 60 detects a total paper feeding length that the paper P is actually fed (total amount that the paper P has been fed) after the initial feeding process in S314. The total paper feeding length is directly detected by the sheet feed sensor 14.

Then, in S330, the CPU 60 determines whether or not a value obtained by subtracting a value obtained by adding up the paper feeding length(s) received in S216 from the total paper feeding length exceeds a predetermined value. The predetermined value may be about 50% of the difference between the amount of discrepancy for a predetermined paper feeding length in the first feeding section (for when the paper P is pressed by the sheet supply roller 9*b*) and the amount of discrepancy for the predetermined paper feeding length in the second feeding section (for when the paper P is not pressed by the sheet supply roller 9*b*). In this manner, the point of change in the amount of discrepancy due to mechanical reasons can be reliably detected individually for each inkjet recording device.

If a positive determination is made in S330 (S330: YES), the CPU 60 sets the calibration mode to the second calibration mode in S332. More specifically, the CPU 60 retrieves the second feeding calibration value that corresponds to the second calibration mode from the calibration mode data stored in the ROM 60 and controls the ASIC 70 to store the retrieved second feeding calibration value into the ROM 170. Then, the process proceeds to S334. On the other hand, if a negative determination is made in S330 (S330: NO), then the process proceeds directly to S334.

In S334, the CPU 60 determines whether or not the printing operation has completed. If not (S334: NO), then the process returns to S316. On the other hand, if so (S334: YES), then in S336, the CPU 60 controls the ASIC 70 to execute the discharge process in the same manner as in S136 of the above-described printing process (1). Then, the current process ends.

In this way, the CPU 60 can determine whether or not the paper P is being contacted by the sheet supply roller 9*b* by detecting the point of change in the amount of discrepancy, without receiving the sheet size data from the computer 100, even if the length differs among sheets of paper P. Thus, in this case also, uneven printing can be prevented.

(Third Modification)

Unevenness in high quality images, such as photographs, due to the change in the amount of discrepancy is more striking than in lower quality images, and such high quality images are more likely to be printed on a glossy paper rather than an ordinary paper.

For example, the friction coefficient between sheets of ordinary paper with the thickness of about 90 μm is about 0.4. However, the friction coefficient between sheets of glossy paper with the thickness of about 225 μm is about 0.6, which is about 1.5 times higher than the friction coefficient between the sheets of ordinary paper with the thickness of about 90 μm. Thus, the feeding resistance exerted on the trailing section of a sheet of paper P when the trailing section thereof is pressed by the sheet supply roller 9*b* is greater for the glossy paper P than for the ordinary paper P. For this reason, when a sheet of glossy paper P is used for printing, the difference between the amount of discrepancy in the first feeding section and that in the second feeding section is greater than when an ordinal paper is used for printing, worsening unevenness in printed images.

Also, the sheet of paper P supplied from the sheet-feed cassette 4 located at the front section of the housing 2 by the sheet supply roller 9*b* is fed following a curved path of 180° by the U-turn path 11 and then discharged out of the housing 2 through the front side thereof. Thus, the greater feeding resistance is applied on the sheet of paper P compared with the case in which the sheet of paper E is fed straight. That is, the sheet of paper P that is fed following a curved path is pressed against the U-turn path 11 because of the stiffness of the sheet and subjected to feeding resistance due to the frictional resistance.

Further, in order to reduce the height of the multifunction device 1, the radius of curvature of the U-turn path 11 needs to be reduced. Because the feeding resistance to which the sheet is subjected increases as the radius of curvature decreases, the feeding resistance to which the sheet is subjected increases as the multifunction device 1 is downsized in the height direction.

Here, the stiffness of a sheet of ordinary paper with the thickness of about 90 μm is about 80 $cm^3/100$. On the other hand, the stiffness of a sheet of glossy paper P with the thickness of about 225 μm is about 450 $cm^3/100$, which is about 5.6 times greater than that of a sheet of ordinary paper with the thickness of about 90 μm. Therefore, the feeding resistance due to the frictional resistance to which a sheet of glossy paper is subjected due to the stiffness thereof is much greater than the feeding resistance to which a sheet of ordinary paper is subjected.

As described above, the feeding resistance to which a sheet of paper is subjected varies depending on the type of paper (ordinary paper or glossy paper, for instance). Thus, the amount of discrepancy varies depending on the type of paper, resulting in uneven printing.

In view of foregoing, it is possible to use a different feeding calibration value not only for each feeding section but also for each sheet type. Details will be provided below.

As shown in FIG. 13(*a*), the ROM 62 includes a first memory region 94*a*(1), a second memory region 94*a*(2), a third memory region 94*b*(1), and a fourth memory region 94*b*(2), each storing calibration data.

As shown in FIGS. 13(*b*) and 13(*c*), the calibration data shows the correspondence among the sheet types, the first and second feeding sections, and feeding calibration values. More specifically, a value of "a" indicating a first sheet type, a value of "1" indicating a first feeding section, and a first calibration value of "A" are stored in the first memory region 94*a*(1), in association with each other. Also, a value of "a" indicating the first sheet type, a value of "2" indicating the second feeding section, and a second calibration value of "B" are stored in the second memory region 94*a*(2), in association with each other. Further, a value of "b" indicating a second sheet type, a value of "1" indicating the first feeding section, and a first feeding calibration value of "Y" are stored in the third memory region 94*b*(1), in association with each other. A value of "b" indicating the second sheet type, a value of "2" indicating the second feeding section, and a second feeding calibration value of "Z" are stored in the fourth memory region 94*b*(2), in association with each other.

Figure 14:
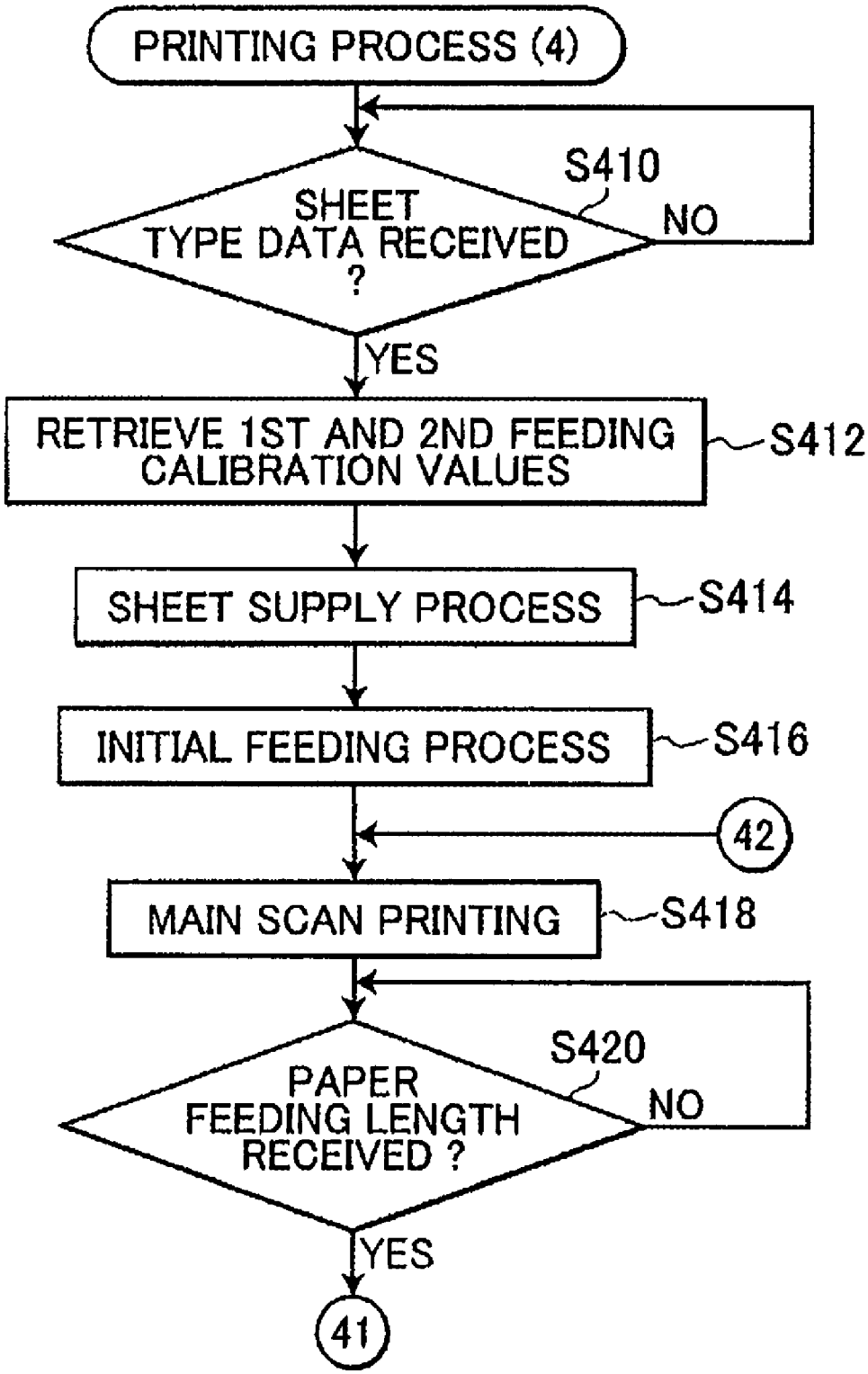
FIG. 14 is a flowchart representing a former half of a printing process (4) according to the third modification.
Figure 15:
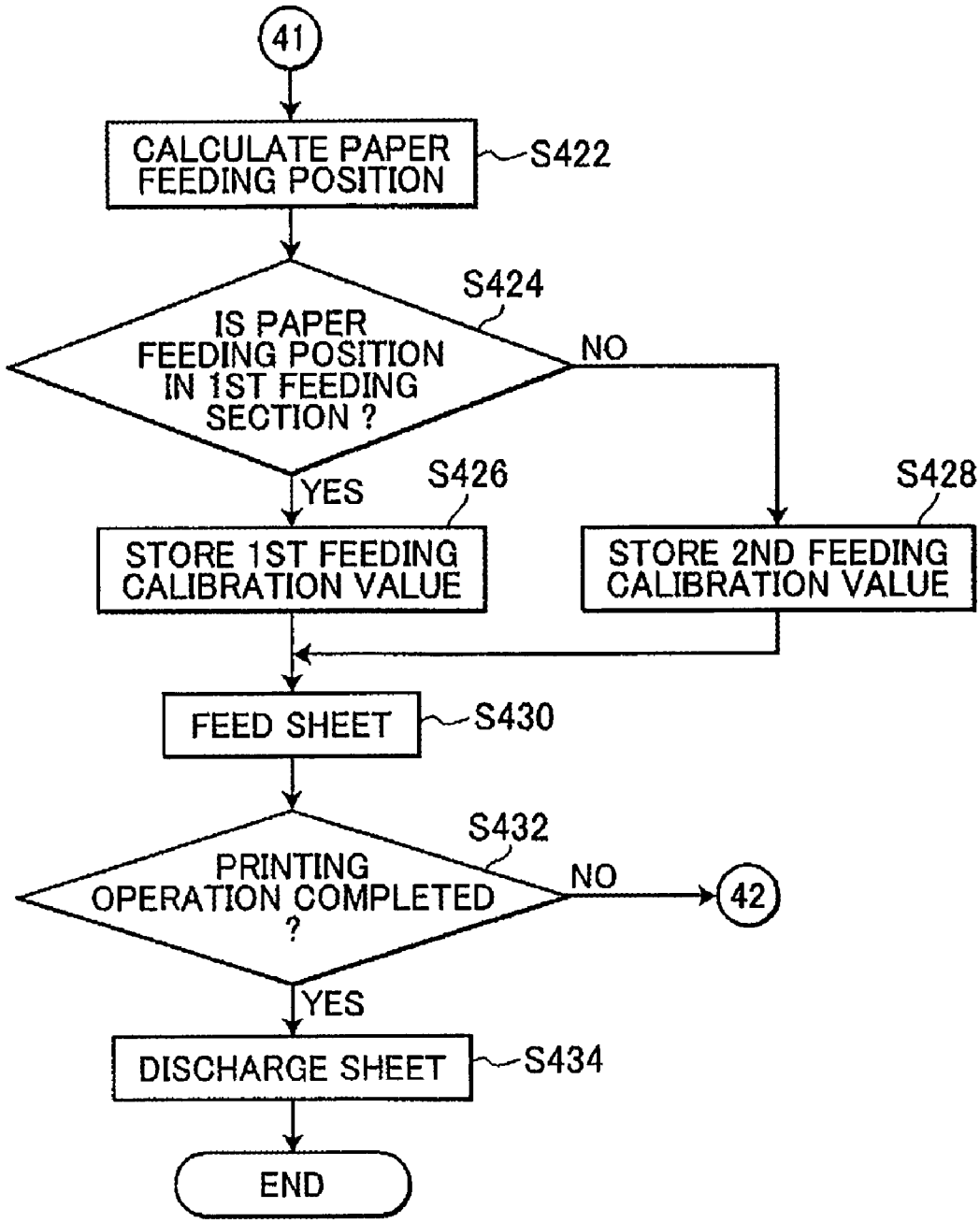
FIG. 15 is a flowchart representing a latter half of the printing process (4)

In this modification, a printing process (4) shown in FIGS. 14 and 15 is executed by the CPU 60. In this printing process (4), first in S410, the CPU 60 determines whether or not sheet type data has been received (S410). Note that the sheet type data inputted through the computer 100 is transmitted to the control unit 50 by way of the USB interface 86. On the other hand, the sheet type data inputted through the operation panel 29 is transmitted to the CPU 60 by the panel interface 84.

If a positive determination is made in S410 (S410: YES), then in S412, the CPU 60 retrieves the first and second feeding calibration values that correspond to the received sheet type data from the ROM 62.

Then, the CPU 60 executes the processes in S414 to S424, which are the same as those in S116 to S126 of the above-described printing process (1). That is, the CPU 60 executes the sheet supply process in S414, the initial feeding process in S416, and the main scan printing in S418. Then, the CPU 60 determines in S420 whether or not the paper feeding length has been received from the computer 100. If so (S420: YES), then the CPU 60 determines the paper feeding position of the sheet of paper P in S422 and determines whether or not the paper feeding position is in the first feeding section in S424. This determination could be made in the same manner as in S126 of FIG. 8, for example.

If the paper feeding position is in the first feeding section (S424: YES), then in S426, the CPU 60 stores the first feeding calibration value, that has been retrieved in S412 and corresponds to both the received sheet type data and the first feeding section, into the ROM 170 of the ASIC 70. Then, the process proceeds to S430.

On the other hand, if the paper feeding position is not in the first feeding section (S424: NO), then in S428, the CPU 60 stores the second feeding calibration value, that has been retrieved in S412 and corresponds to both the received sheet type data and the second feeding section, into the ROM 170. Then, the process proceeds to S430.

In S430, the CPU 60 controls the ASIC 70 to feed the paper P by the paper feeding length received in S420 by using the feeding calibration value stored in the ROM 170. More specifically, under the control of the CPU 60, the ASIC 70 retrieves the feeding calibration value from the ROM 170 and controls the motor drive section 82 to feed the paper P the paper feeding length received in S420 based on the retrieved feeding calibration value. Then, the process proceeds to S432.

In S432, the CPU 60 determines whether or not the printing operation has completed. If not (S432: NO), then the process returns to S418. On the other hand, if so (S432: YES), then in S434, the CPU 60 controls the ASIC 70 to execute the discharge process in the same manner as in S136 of the above-described printing process (1). Then, the current process ends.

In this way, the feeding amount can be appropriately calibrated both in the first and second feeding sections even if sheets of paper P with different coefficient of friction and different thickness are used, thereby preventing uneven printing.

Here, the feeding calibration values for different sheet types may be obtained and stored in the ROM 62 at the time of manufacturing the multifunction device 1 in a manner described below.

Figures 16A, 16B, 16C, 16D, 16E:
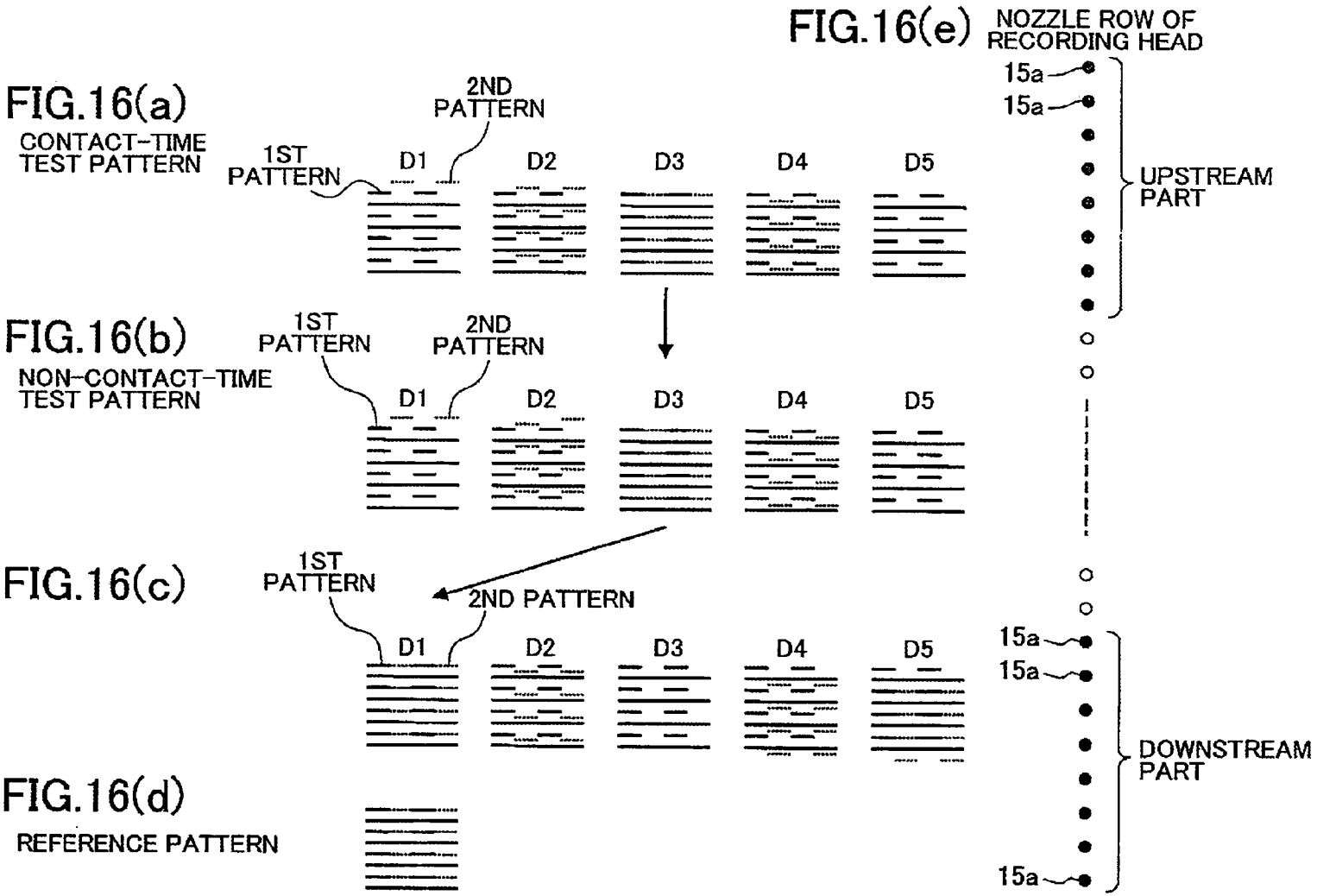
FIG. 16(*a*) shows a contact-time test pattern for a first feeding section.

The RAM 64 stores a contact-time test pattern shown in FIG. 16(*a*) and a non-contact-time test pattern shown in FIG. 16(*b*). Each of the contact-time test pattern and the non-contact-time test pattern includes five design patterns D1 to D5, which respectively have identification numbers 1 through 5. Each of the design patterns D1 to D5 is formed of a first pattern indicated by solid lines and a second pattern indicated by dotted lines. The positional relationship between the first pattern and the second pattern slightly differs among the five design patterns D1 to D5.

Here, as shown in FIG. 16(*e*), the recording head 15 is formed with a row of nozzles 15*a* extending in the sheet feeding direction. In a process described later, the first pattern is printed by using nozzles 15*a* located at the downstream side in the sheet feeding direction, whereas the second pattern is printed by using nozzles 15*a* located at the upstream side in the sheet feeding direction. Also, the contact-time test pattern is printed in the first feeding section of a sheet of paper P (when the sheet of paper P is contacted by the sheet supply roller 9*b*). On the other hand, the non-contact-time test pattern is printed in the second feeding section of the sheet (when the sheet is not contacted by the sheet supply roller 9*b*).

The contact-time test pattern is designed such that the first pattern aligns with the second pattern in the central design pattern D3 as shown in FIG. 16(*a*) when the contact-time test pattern is printed in the first feeding section of the sheet of paper P in an ideal multifunction device while calibrating a feeding amount according to a predetermined first reference calibration value. The non-contact-time test pattern is designed such that the first pattern aligns with the second pattern in the central design pattern D3 as shown in FIG. 16(*b*) when the non-contact-time test pattern is printed in the second feeding section of the sheet of paper P in the ideal multifunction device while calibrating a feeding amount according to a predetermined second reference calibration value.

Note that the first and second reference calibration values are average values of the amounts of discrepancy in all multifunctional devices of the same model. Because the average value for the first feeding section where a large feeding slip takes place differs from the average value for the second feeding section where a relatively small feeding slip takes place, the first reference calibration value differs from the second reference calibration value.

It should be also noted that when the contact-time test pattern is printed in the second feeding section of the sheet of paper P, the first pattern aligns with the second pattern in the leftmost design pattern D1 as shown in FIG. 16(*c*). In other words, the first pattern does not align with the second pattern in the design pattern D3. This is because the feeding amount is calibrated according to the first reference calibration value in the second feeding section where a small feeding slip takes place, and the sheet of paper P has been fed more than necessary before the second pattern is printed.

The ROM 62 stores the reference pattern shown in FIG. 16(*d*) in advance. The reference pattern is a pattern in which the first pattern aligns with the second pattern.

The RAM 64 also stores a reference table shown in FIG. 17(*a*) and equations (1) and (2) shown in FIG. 17(*b*). The reference table shows a numerical value "c" that indicates the difference in a feeding amount between the ordinary paper and the glossy paper in the first feeding section and a numerical value "d" that indicates the difference in a feeding amount between the ordinary paper and the glossy paper in the second feeding section. The numerical values "c" and "d" are obtained by sampling and stored in the RAM 64 in advance.

Next, an automatic judgment process executed by the CPU 60 will be described with reference to FIG. 18. The automatic judgment process is executed when the multifunction device 1 is ON and test pattern printing is instructed through the operation panel 29.

Figure 19:
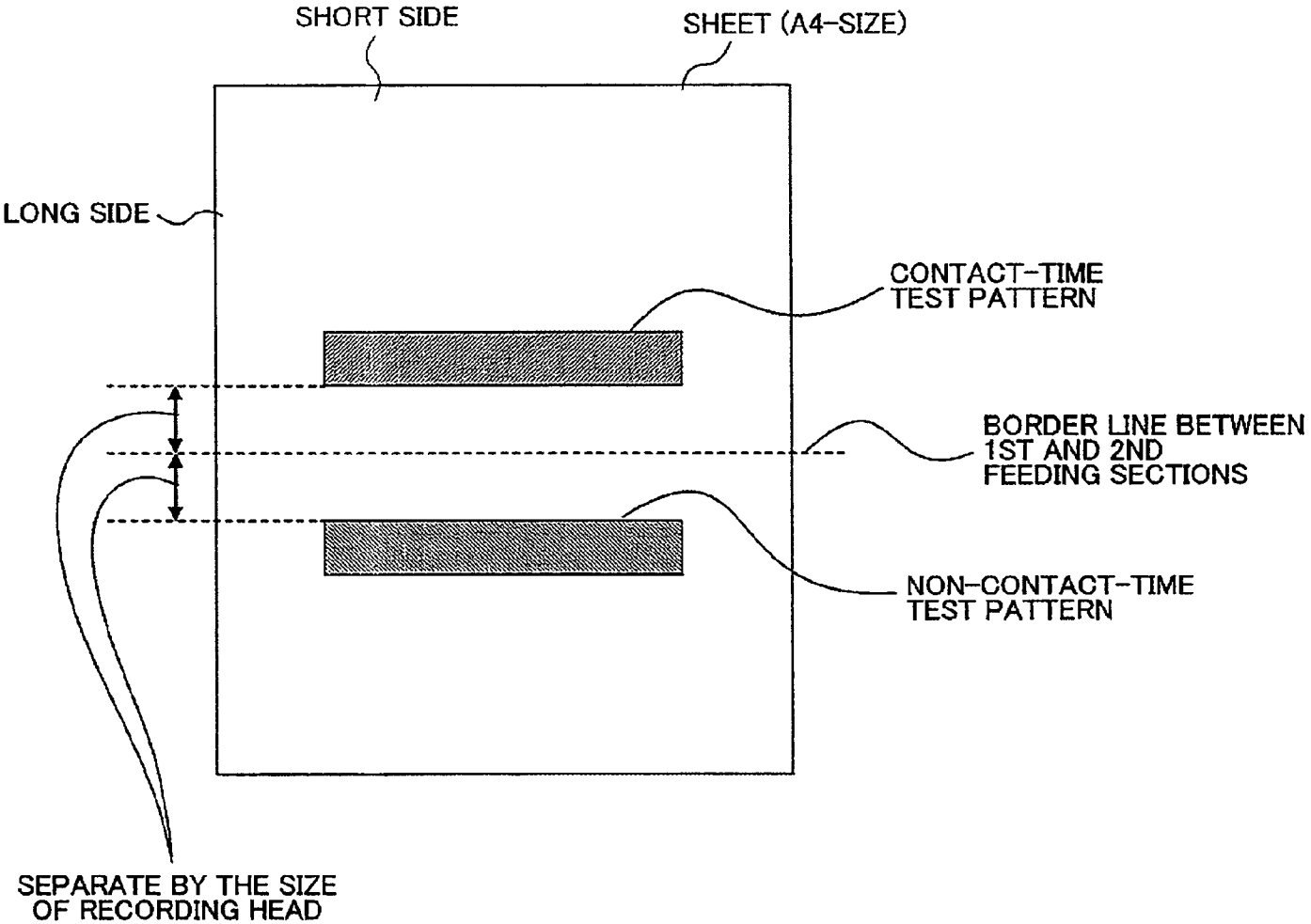
FIG. 19 is a schematic view showing printing positions of the contact-time test pattern and the non-contact-time test pattern.

First in S710, the CPU 60 prints the test patterns (the contact-time test pattern and the non-contact-time test pattern) on a sheet of ordinary paper P. More specifically, the CPU 60 controls the sheet supply roller 9*b* to supply the sheet of paper P from the sheet-feed cassette 4 and also controls the recording head 15, the carriage 17, and the feeding roller 41 such that the test patterns are printed on the sheet of paper P by repeating the printing operation to eject ink from the recording head 15 while moving the carriage 17 and the feeding operation to feed the sheet of paper a predetermined distance. At this time, the contact-time test pattern retrieved from the RAM 64 is printed in the first feeding section, and the non-contact-time test pattern retrieved from the RAM 64 is printed in the second feeding section as described above. Note that when printing the test patterns on an A4-size sheet, the contact-time test pattern and the non-contact-time test pattern are printed at positions away from a border line between the first and second feeding regions, at least a distance equal to the width of the recording head 15 in the sheet feeding direction, as shown in FIG. 19.

Subsequently in S720, the CPU 60 reads the test patterns from the sheet of paper P using the image reader 23. Note that the image reader 23 is capable of reading the test patterns with a resolution at least twice as high as the resolution with which the recording head 15 prints the test patterns on the sheet. Thus, the image reader 23 can read the test patterns quite well.

Then in S730, the CPU 60 judges the appropriateness of the contact-time test pattern and that of the non-contact-time test pattern read in S720. More specifically, the CPU 60 identifies one of the design patterns D1 to D5 that is closest to the reference pattern shown in FIG. 16(*d*), for each of the contact-time test pattern and the non-contact-time test pattern, and extracts the identification numbers of the identified design patterns. Then in S740, the CPU 60 determines feeding calibration values according to the extracted identification numbers. For example, a table showing the correspondence between the identification numbers of the design pattern D1 to D5 and the feeding calibration values may be prepared in advance and stored for each of the first and second feeding sections. In this case, the CPU 60 only needs to read the feeding calibration values that respectively correspond to the extracted identification numbers. In this manner, the feeding calibration values for the first and second feeding sections in the ordinary paper P can be determined.

Then in S750, the CPU 60 determines the feeding calibration values for the glossy paper P. More specifically, the CPU 60 determines the feeding calibration value for the first feeding section of the glossy paper using the equation (1) shown in FIG. 17(*b*) based both on the feeding calibration value for the first feeding section of the ordinary paper determined in S740 and the value of "c" stored in the RAM 64 as shown in FIG. 17(*a*) and also determines the feeding calibration value for the second feeding section of the glossy paper using the equation (2) shown in FIG. 17(*b*) based both on the feeding calibration value for the second feeding section of the ordinary paper determined in S740 and the value of "d" stored in the RAM 64 as shown in FIG. 17(*b*).

Thereafter, the CPU 60 stores the feeding calibration values determined in S740 and S750 in corresponding memory regions 94*a*(1) to 94*b*(2) of the ROM 62 shown in FIG. 13 as values of "A", "B", "Y", and "Z". Then, the current process ends.

Thus, with this modification, the feeding calibration values for a sheet of paper other than ordinary paper, such as glossy paper, can be determined by judging the appropriateness of the test patterns printed on a sheet of ordinary paper, without judging the degree of appropriateness for other type of paper. Thus, it is possible to reduce the cost required for determining feeding calibration values of each of multifunction devices at the time of manufacture, thereby decreasing the manufacturing cost.

Also, because the contact-time test pattern is provided for the first feeding section and the non-contact-time test pattern differing from the contact-time test pattern is provided for the second feeding section, a design pattern in which the first pattern should align with the second pattern can be located at the center of the five design pattern D1 to D5 in both the contact-time test pattern and the non-contact-time test pattern, by using respective first and second reference calibration values. Thus, the calibration range can be broader than when a single test pattern is used both as the contact-time test pattern and the non-contact-time test pattern. Further, since the contact-time test pattern and the non-contact-time test pattern have a similar configuration, a pattern for a main scan operation to eject ink from the recording head 15 can be the same for both the first and second feeding sections, thereby reducing the required memory capacity.

Moreover, since feeding calibration values are determined for each multifunction device 1, the feeding roller 41 of the multifunction device 1 can be controlled properly according to the feeding calibration values.

Also, in this modification, the test patterns printed on a sheet of ordinary paper is retrieved by the image reader 23, and the appropriateness of the test patterns is automatically judged by the CPU 60. Therefore, it is unnecessary to require an inspector to visually check the appropriateness of printed test patterns, and thus the load of the inspector in the manufacturing process and the number of manufacturing steps can be reduced.

(Fourth Modification)

Here, the rate of feeding of a sheet or paper P is stable when the sheet of paper P is not contacted by the sheet supply roller 9*b*. Thus, it is possible to determine the feeding calibration values without printing the contact-time test pattern. In this case, only the non-contact-time test pattern is printed on a sheet of ordinary paper, and the feeding calibration values are determined based on the appropriateness of the printed non-contact-time test pattern through calculation.

More specifically, the RAM 64 stores a reference table shown in FIG. 20(*a*) and equations (3) to (5) shown in FIG. 20(*b*). The reference table shows a numerical value "e" that indicates the difference in amount of discrepancy between the first and second feeding sections of a sheet of ordinary paper P, a numerical value "f" that indicates the difference in the amount of discrepancy in the second feeding section between a sheet of ordinary paper and a sheet of glossy paper, and a numerical value "g" that indicates the difference in the amount of discrepancy between the first and second feeding sections of the sheet of glossy paper. The numerical values "e", "f", and "g" are obtained by sampling and stored in the RAM 64 in advance. The feeding calibration value for the second feeding section of the ordinary paper can be determined in the same manner as in the above-described modification. The feeding calibration values for the first feeding section of the ordinary paper and for the first and second feeding sections of the glossy paper can be determined using the equations (3) to (5) shown in FIG. 20(*b*) with reference to the reference table shown in FIG. 20(*a*).

Because it is unnecessary to print the contact-time test pattern and judge the appropriateness of the printed contact-time test pattern in this modification, the cost required for determining the feeding calibration values can be reduced, thereby reducing the manufacturing cost of the multifunction device 1.

(Fifth Modification)

In the above-described third modification, the appropriateness of the printed test patterns is automatically determined by the CPU 60. However, the appropriateness of the printed test patterns may be determined visually by an inspector. In this case, a visual judgment process shown in FIG. 21 is executed by the CPU 60, rather than the automatic judgment process in FIG. 18. The visual judgment process is executed when the multifunction device 1 is ON and a test pattern printing is instructed through the operation panel 29.

Figures 17A, 17B, 18:
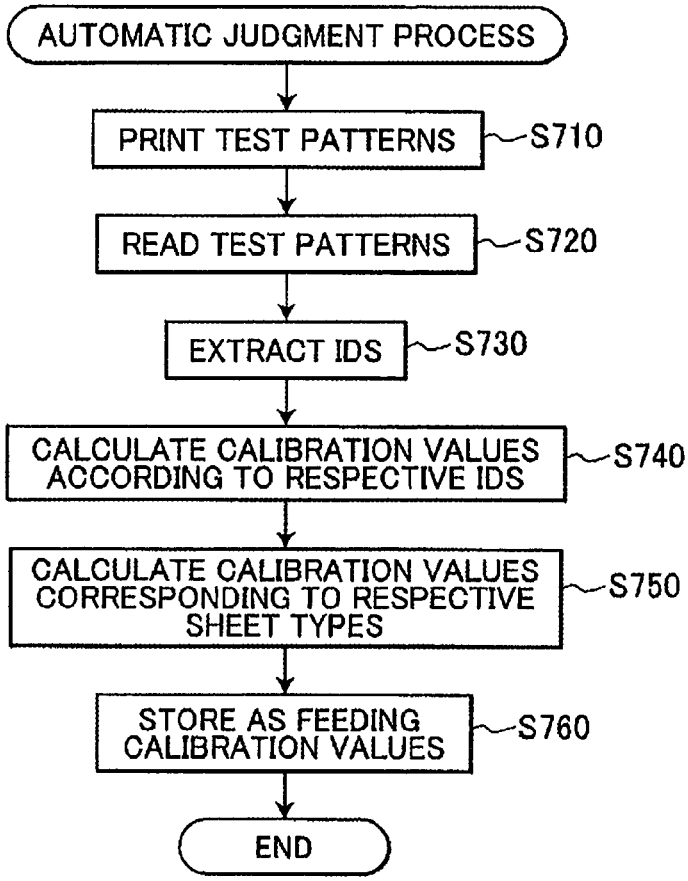
FIG. 18 is a flowchart representing an automatic judgment process according to the third modification.

In the visual judgment process, first in S820, the CPU 60 prints the test patterns in the same manner as in S710 of the above-described automatic judgment process in FIG. 18. After examining the printed test patterns, the inspector determines an identification number of a design pattern that is closest to the reference pattern, for each of the test patterns, and input the identification numbers through the operation panel 29.

In S830, the CPU 60 receives the identification numbers input by the inspector. In S840, the feeding calibration values for the first and second feeding sections of the ordinary paper P are determined based on the inputted identification numbers, in the same manner as in S740 of FIG. 18. Then, the process proceeds to S850. Since the processes in S850 and S860 are the same as those in S750 and S760 of FIG. 18, detailed description thereof will be omitted.

(Sixth Modification)

In the above-described third modification, the sheet type data is received through the computer 100 or the operation panel 29. However, the type of sheet of paper P may be detected using a glossiness sensor that detects the glossiness of the surface of a sheet of paper P. For example, as indicated by broken lines in FIG. 3, a glossiness sensor 12 is disposed between the sheet supply roller 9*b* and the feeding roller 41 with respect to the sheet feeding direction. As shown in FIG. 4, the glossiness sensor 12 is electrically connected to the ASIC 70, so that signals from the glossiness sensor 12 are input to the ASIC 70. The glossiness sensor 12 may be a glossiness judging sensor of the visible red light LED type that is adapted to detect the extent by which the beam of light irradiated only a paper P in a predetermined angle is reflected diagonally.

As shown in FIG. 22(*a*), the ROM 62 includes a first memory region 96*a*(1), a second memory region 96*a*(2), a third memory region 96*b*(1), and a fourth memory region 96*b*(2), all storing glossiness data.

As shown in FIGS. 22(*b*) and 22(*c*), the glossiness data indicates the correspondence among the glossiness of paper P, the first and second feeding sections, and feeding calibration values.

More specifically, a value of "a" indicating a first glossiness degree of paper P is stored in the first memory region 96*a*(1) in association with a value of "1" indicating the first feeding section and a first calibration value of "A". A value of "a" indicating the first glossiness degree of paper P is also stored in the second memory region 96*a*(2) in association with a value of "2" indicating the second feeding section and a second calibration value of "B". Similarly, a value of "b" indicating a second glossiness degree of paper P is stored in the third memory region 96*b*(1) in association with a value of "1" indicating the first feeding section and a first feeding calibration value of "Y", and a value of "b" indicating the second glossiness degree of paper P is stored in the fourth memory region 96*b*(2) in association with a value of "2" indicating the second feeding section and a second feeding calibration value of "Z".

Figure 23:
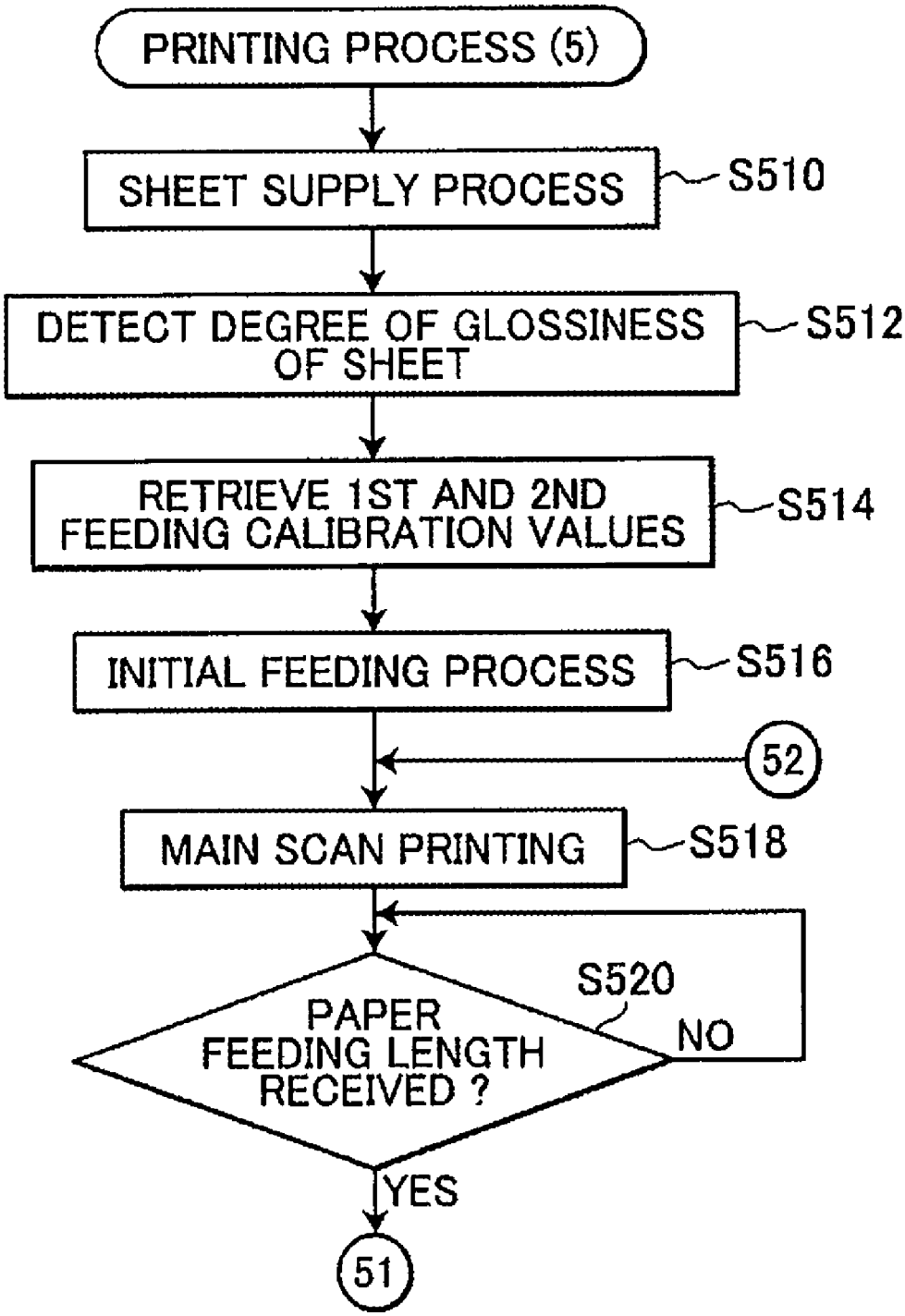
FIG. 23 is a flowchart representing a former half of a printing process (5) according to the sixth modification.
Figure 24:
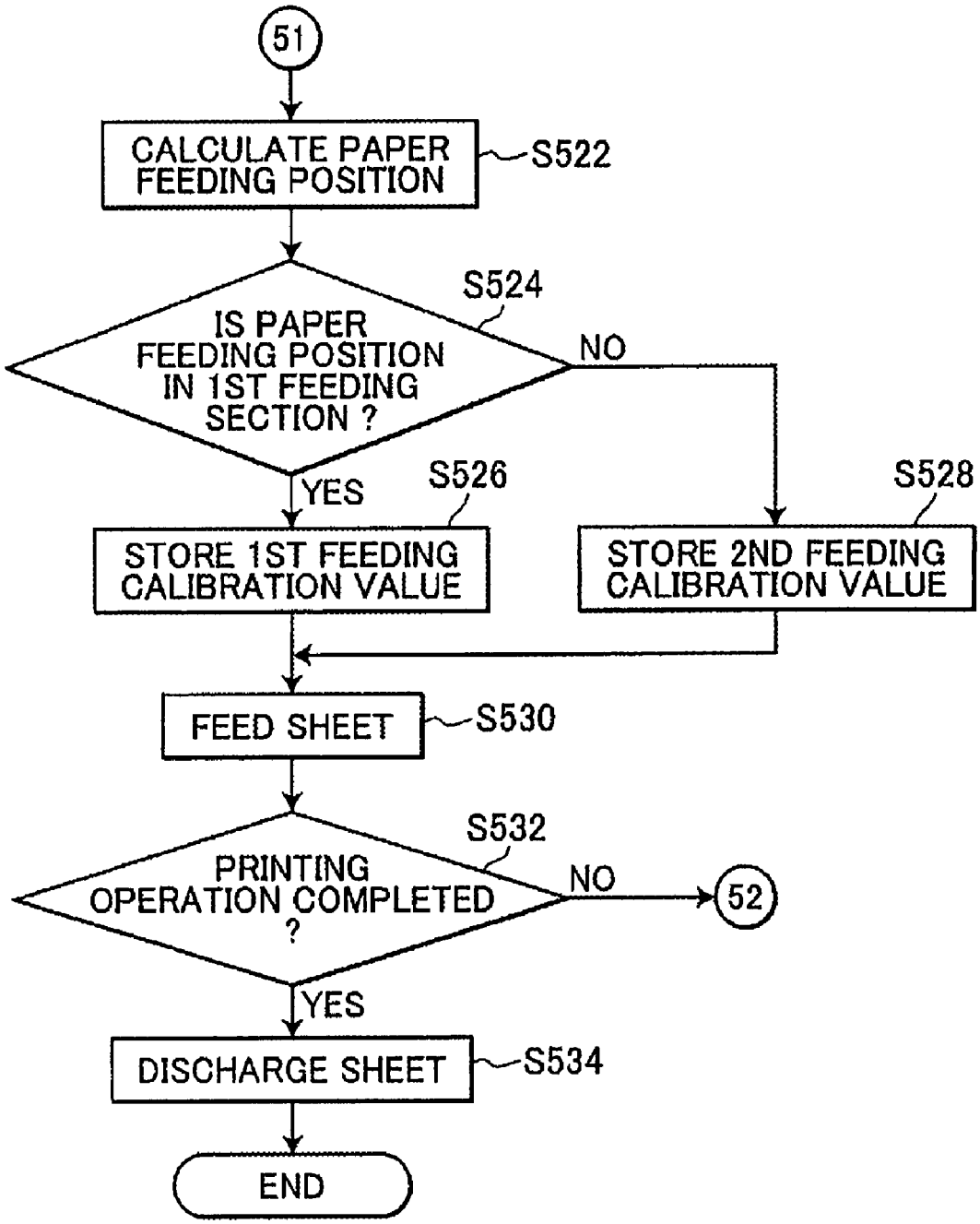
FIG. 24 is a flowchart representing a latter half of the printing process (5)

In this modification, a printing process (5) shown in FIGS. 23 and 24 are executed by the CPU 60.

First in S510, the sheet supply process is executed. Then in S512, the degree of glossiness of the surface of the paper P is detected using the glossiness sensor 12. Next in S514, the CPU 60 retrieves the first and second feeding calibration values that corresponds to the glossiness degree detected in S512 from the ROM 62.

Then, the CPU 60 executes the processes in S516 to S524, which are the same as those in S118 to S126 of the above-described printing process (1). That is, the CPU 60 executes the initial feeding process in S516 and the main scan printing in S518 and then determines in S520 whether or not the paper feeding length has been received from the computer 100. If so (S520: YES), then the CPU 60 determines the paper feeding position in S522 and determines whether or not the paper feeding position is in the first feeding section in S524.

If the paper feeding position is in the first feeding section (S524: YES), then in S526, the CPU 60 controls the ASIC 70 to store the first feeding calibration value, that has been retrieved in S514 and corresponds both to the detected glossiness degree and the first feeding section, into the ROM 170. Then, the process proceeds to S530. On the other hand, if the paper feeding position is not in the first feeding section (S524: NO), then in S528, the CPU 60 controls the ASIC 70 to store the second feeding calibration value, that has been retrieved in S514 and corresponds both to the detected glossiness degree and the second feeding section, into the ROM 170. Then, the process proceeds to S530.

In S530, the CPU 60 controls the ASIC 70 to feed the paper P the paper feeding length received in S520 using the feeding calibration value stored in the ROM 170. More specifically, under the control of the CPU 60, the ASIC 70 retrieves the feeding calibration value from the ROM 170 and controls the motor drive section 82 to feed the paper P the paper feeding length received in S520 based on the retrieved feeding calibration value. Then, the process proceeds to S532.

In S532, the CPU 60 determines whether or not the printing operation has completed. If not (S532: NO), then the process returns to S518. On the other hand, if so (S532: YES), then in S534, the CPU 60 controls the ASIC 70 to execute the discharge process in the same manner as in S136 of the above-described printing process (1). Then, the current process ends.

In this modification, since the glossiness degree of the sheet of paper P is detected to identify the sheet type, such as ordinary paper or glossy paper, the difference in the amount of discrepancy between the first feeding section and the second feeding section can be suppressed even if friction coefficient or thickness differs among sheets of paper P, thereby preventing uneven printing.

(Seventh Modification)

In the above, the invention is applied to the multifunction device 1 including the single sheet-feed cassette 4. However, the invention may also be applied to a multifunction device including a plurality of sheet-feed cassettes. In this case, feeding calibration values corresponding to the first and second feeding sections are determined in advance for each of the plurality of sheet-feed cassettes.

Figure 25:
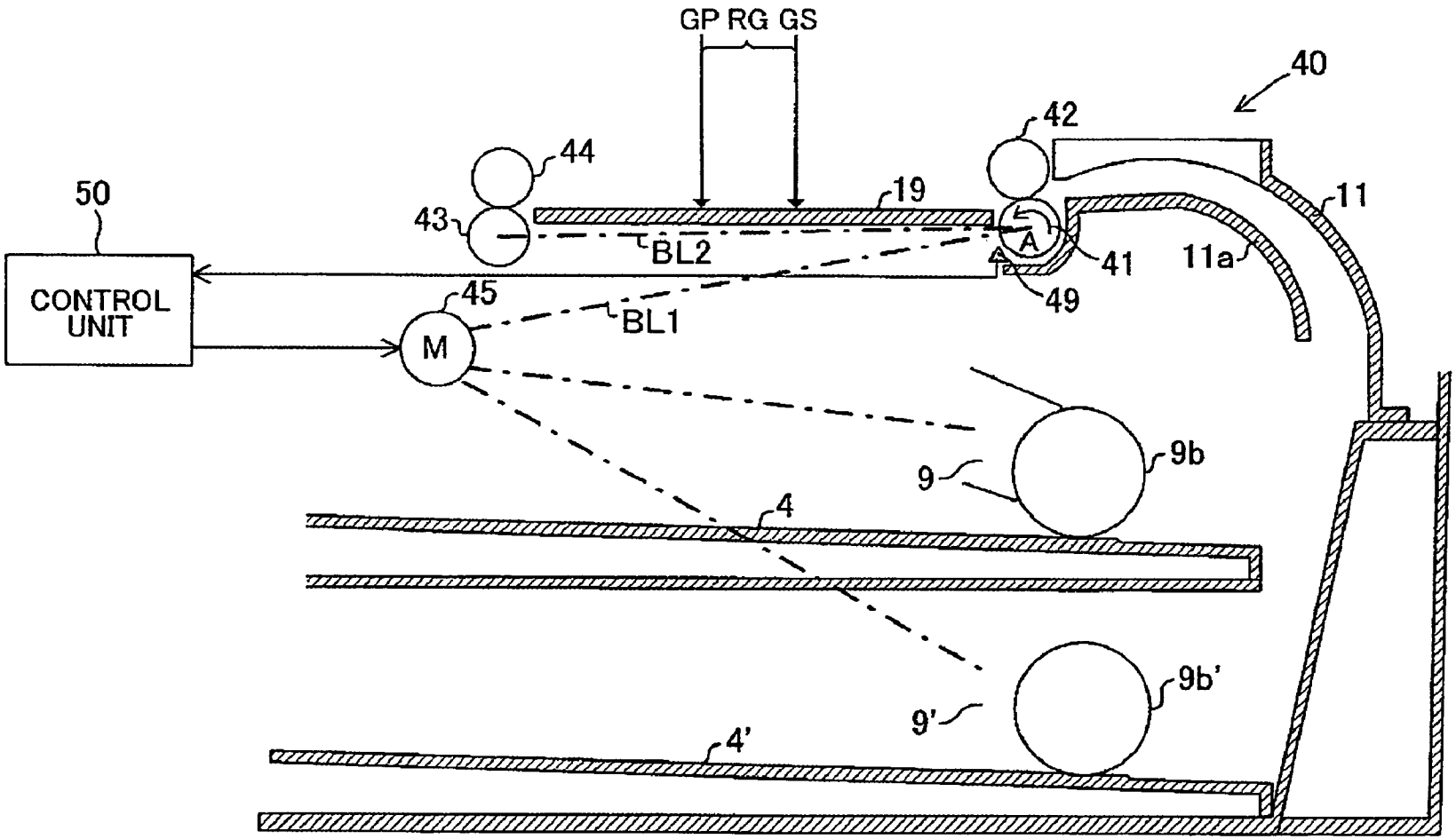
FIG. 25 is a simplified schematic cross-sectional view of a sheet feeding mechanism of a multifunction device according to a seventh modification.

More specifically, as shown in FIG. 25, a multifunction device of this modification includes two sheet-feed cassettes 4 and 4'. The sheet feeding cassettes 4 and 4' have respective sheet feeding sections 9 and 9' for separating and supplying the paper P accommodated in the sheet feeding cassettes 4 and 4' one sheet at a time. The sheet feeding sections 9 and 9' include respective sheet supply rollers 9*b* and 9*b'* to which rotational power generated by the sheet feeding motor 45 is transmitted by way of transmission mechanisms (not shown). Also, as shown in FIG. 26(*a*), memory regions 98*a*(1) through 98*b*(2) for storing cassette data are provided to the ROM 62.

As shown in FIGS. 26(*b*) and 26(*c*), the cassette data indicates the correspondence among the sheet-feed cassettes 4 and 4', the first and second feeding sections, and feeding calibration values.

More specifically, a value "a" indicating the sheet-feed cassette 4 is stored in the memory region 98*a*(1) in association with a value "1" indicating the first feeding section and a first feeding calibration value of "A". A value "a" indicating the sheet-feed cassette 4 is stored in the memory region 98*a*(2) in association with a value "2" indicating the second feeding section and a second feeding calibration value of "B". Similarly, a value "b" indicating the sheet-feed cassette 4' is stored in the memory region 98*b*(1) in association with a value "1" indicating the first feeding section and a first feeding calibration value of "Y", and a value "b" indicating the sheet-feed cassette 4' is stored in the memory region 98*b*(2) in association with a value "2" indicating the second feeding section and a second feeding calibration value of "Z".

Figure 27:
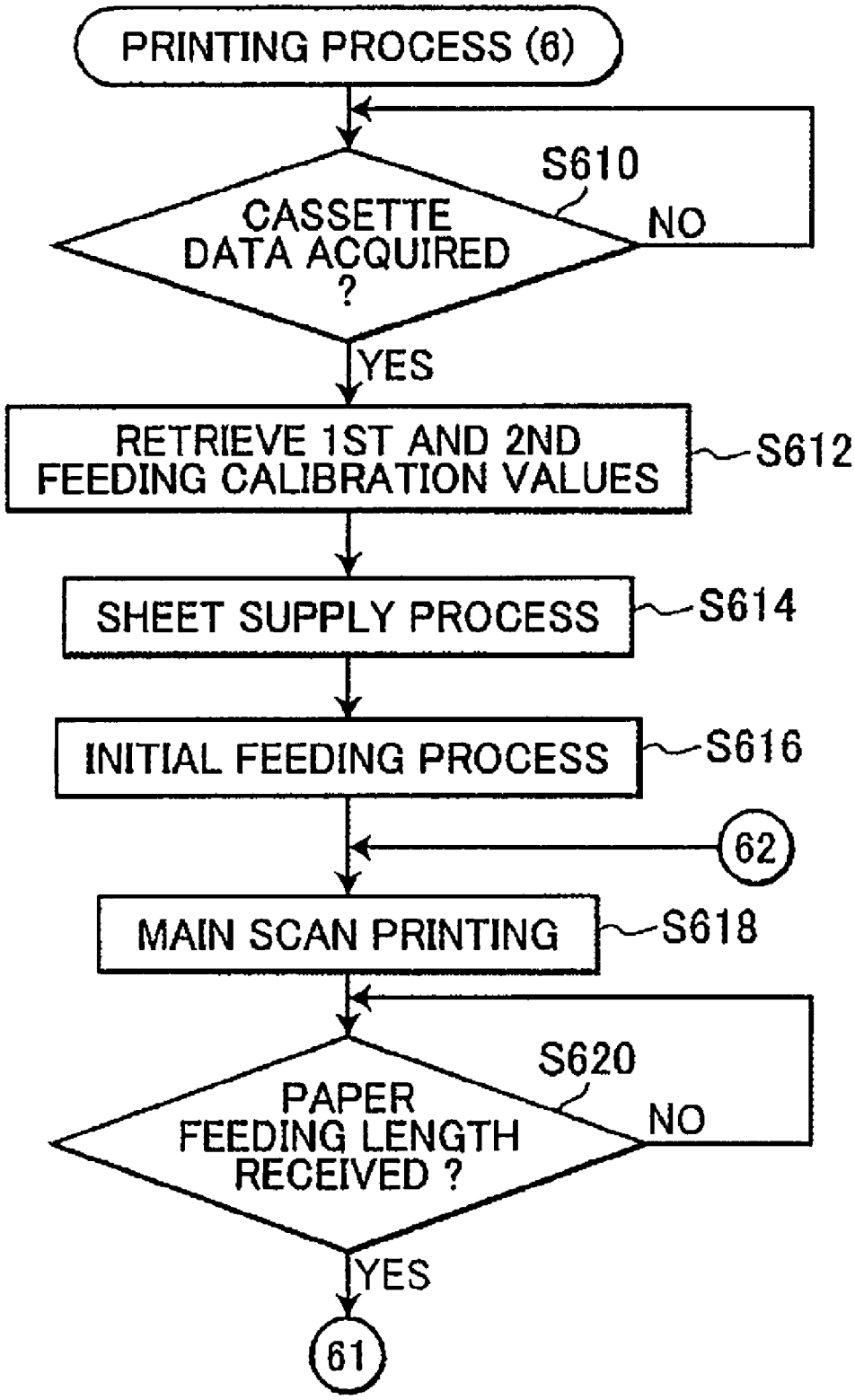
FIG. 27 is a flowchart representing a former half of a printing process (6) according to the seventh modification.
Figure 28:
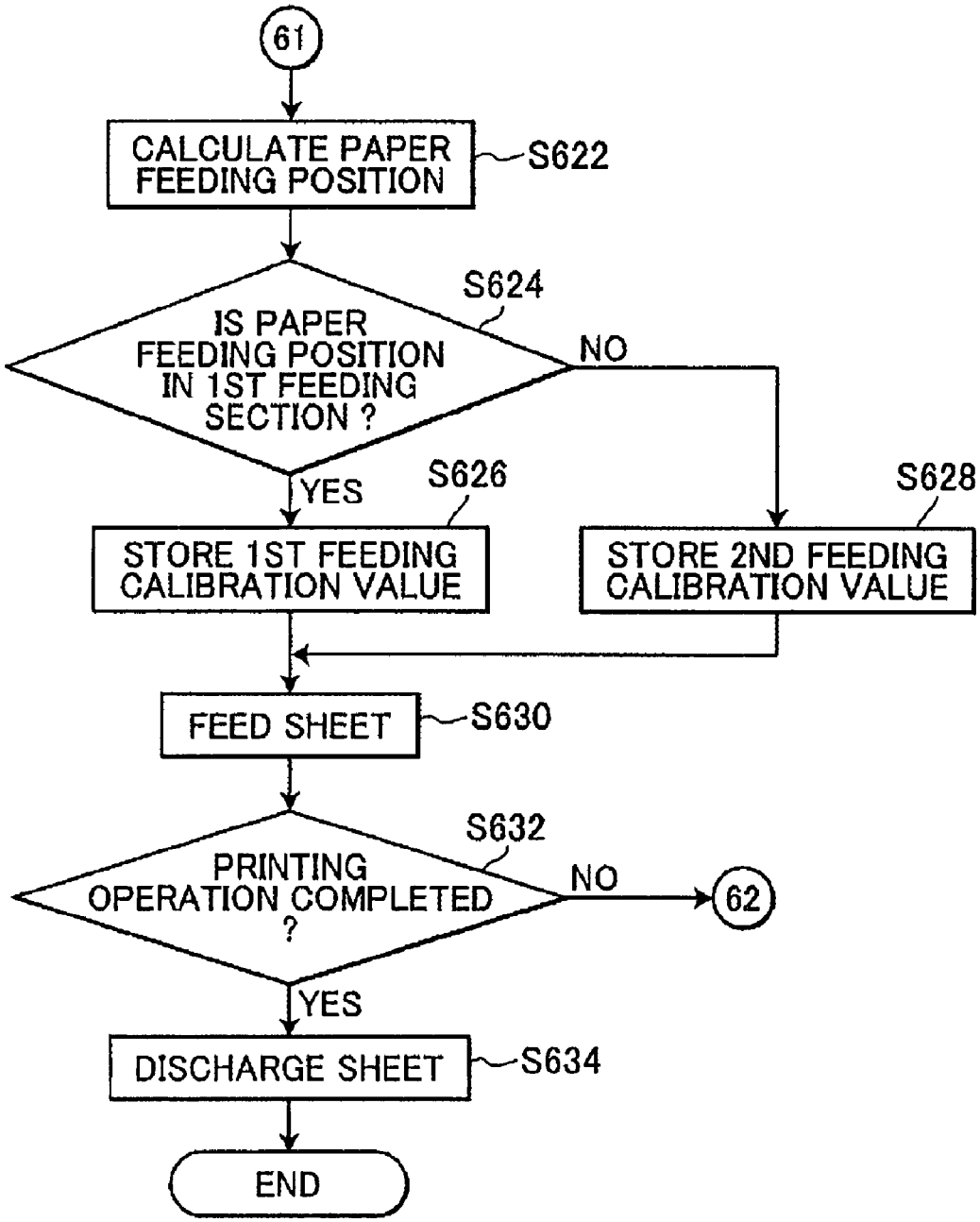
FIG. 28 is a flowchart representing a latter half of the printing process (6).

In this modification, a printing process (6) shown in FIGS. 27 and 28 is executed by the CPU 60.

In the printing process (6), it is first determined in S610 whether or not cassette data is received. Note that the cassette data inputted through the computer 100 is transmitted from the computer 100 to the control unit 50 by way of the USB interface 86. On the other hand, when the cassette data is inputted through the operation panel 29, the cassette data is transmitted to the CPU 60 by the panel interface 84.

If it is determined in S610 that the cassette data is not received (S610: NO), the process waits until the cassette data is received. On the other hand, if it is determined that the cassette data is received (S610: YES), then in S612, the CPU 60 retrieves the first and second feeding calibration values that correspond to the received cassette data from the ROM 62.

Then, the CPU 60 executes the processes in S614 to S624, which are the same as those in S116 to S126 of the above-described printing process (1). That is, the CPU 60 executes the sheet supply process in S614, the initial feeding process in S616, and the main scan printing in S618. Then, the CPU 60 determines in S620 whether or not the paper feeding length has been received from the computer 100. If so (S620: YES), then the CPU 60 determines the paper feeding position of the sheet of paper P in S622 and determines whether or not the paper feeding position is in the first feeding section in S624.

If the paper feeding position of the sheet of paper P is in the first feeding section (S624: YES), then in S626, the CPU 60 controls the ASIC 70 to store the first feeding calibration value, that has been retrieved in S612 and corresponds both to the first feeding section and the received cassette data, into the ROM 170 of the ASIC 70. Then, the process proceeds to S630.

On the other hand, if the paper feeding position is not in the first feeding section (S624: NO), then in S628, the CPU 60 controls the ASIC 70 to store the second feeding calibration value, that has been retrieved in S612 and corresponds both to the second feeding section and the received cassette data, into the ROM 170. Then, the process proceeds to S630.

In S630, the CPU 60 controls the ASIC 70 to feed the paper P the paper feeding length received in S620 using the feeding calibration value stored in the ROM 170. More specifically, under the control of the CPU 60, the ASIC 70 retrieves the feeding calibration value from the ROM 170 and controls the motor drive section 82 to feed the paper P the paper feeding length received in S620 based on the retrieved feeding calibration value. Then, the process proceeds to S632.

In S632, the CPU 60 determines whether or not the printing operation has completed. If not (S632: NO), then the process returns to S618. On the other hand, if so (S632: YES), then in S634, the CPU 60 controls the ASIC 70 to execute the discharge process in the same manner as in S136 of the above-described printing process (1). Then, the current process ends.

In this way, according to the present modification, feeding calibration values for the first and second feeding sections can be defined for each of the plurality of sheet-feed cassettes 4 and 4'. Therefore, even if the shapes and the lengths of the feeding paths, along which the sheets of paper P are respectively fed from the sheet-feed cassettes 4 and 4' by the sheet supply rollers 9*b* and 9*b*, differ from each other, the difference in feeding amount of paper P can be suppressed by calibrating the feeding amount using feeding calibration values suitable for respective sheet-feed cassettes 4 and 4', thereby preventing uneven printing.

(Others)

There have been described the multifunction device 1 and the first to seventh modifications thereof. However, various other modifications are possible, although description of all other possible modifications is not provided. For example, in the second modification, the calibration values are selectively used in accordance with the feeding sections of a sheet of paper P. However, the calibration values may be selectively used in accordance with not only the feeding sections but also at least one of the type of paper, the glossiness of the paper, the sheet-feed cassette to be used, and the like. Also, in the seventh modification, the calibration values are selectively used in accordance with the feeding sections and the sheet-feed cassette to be used, However, the calibration values may be selectively used further in accordance with at least one of the type of paper, the glossiness of the paper, and the like.

In the above descriptions, feeding calibration values are provided for two of the first and second feeding sections. However, when the feeding resistance of paper differs among more than two feeding sections, feeding calibration values may be provided for these feeding sections. For example, the feeding sections may be defined based further on whether the sheet of paper P is contacted by the discharge roller 43 and the pinch roller 44.

In this case, even if the feeding resistance of paper differs among more than two feeding sections, it is possible to reduce the difference in the feeding amount by providing an appropriate feeding calibration value for each of the feeding sections.

Also, the number of sheet size is not limited to two, but could be more than two. If sheets of paper having more than two different sizes are used, the feeding calibration values may be provided for each of these sheet sizes to reduce the difference in the feeding amount, so that the uneven printing is prevented.

What is claimed is:

1. An inkjet recording device comprising:

a feeding section capable of accommodating a stack of recording medium;

a supply roller that supplies the recording medium one at a time from the feeding section;

a recording unit including a recording head that ejects ink onto a recording medium and a carriage that reciprocatingly moves in a first direction while mounting the recording head thereon, wherein the recording unit performs printing operation in which the recording head ejects ink onto the recording medium while the carriage is moving in the first direction;

a feeding member that feeds the recording medium supplied by the supply roller in a second direction substantially perpendicular to the first direction when the recording unit is not performing the printing operation;

a judgment unit that judges whether the recording medium is in contact with the supply roller;

a controller that controls the recording unit and the feeding member to repeatedly perform the printing operation and the feeding operation in alternation so as to form an image on the recording medium; and a memory that stores a first calibration value and a second calibration value, wherein the controller controls the feeding member to feed the recording medium while calibrating a feeding amount of the recording medium based on the first calibration value when the judgment unit has judged that the recording medium is in contact with the supply roller; and the controller controls the feeding member to feed the recording medium while calibrating the feeding amount based on the second calibration value when the judgment unit has judged that the recording medium is not in contact with the supply roller.

2. The inkjet recording device according to claim 1, further comprising a receiving unit that receives size data indicating a size of recording medium, wherein the memory further stores a plurality of sets of length data each corresponding to one of different sizes of recording medium, the length data indicating a length of recording medium in the second direction;

the feeding section is capable of accommodating a stack of recording medium of a different size; and the judgment unit retrieves the length data corresponding to the size data received by the receiving unit; and the judgment unit judges whether the recording medium is in contact with the supply roller based on the retrieved length data.

3. The inkjet recording device according to claim 1, further comprising a trailing edge sensor that detects when the recording medium supplied by the supply roller separates from the supply roller, wherein the judgment unit judges that the recording medium is in contact with the supply roller when the trailing edge sensor does not detect that the recording medium has separated from the supply roller, and the judgment unit judges that the recording medium is not in contact with the supply roller when the trailing edge sensor has detected that the recording medium has separated from the supply roller.

4. The inkjet recording device according to claim 1, further comprising a receiving unit that receives type data indicating a type of recording medium, wherein:

the memory stores a plurality of first calibration values each corresponding to one of a plurality of types of recording medium and a plurality of second calibration values each corresponding to one of the plurality of types of recording medium;

the controller controls the feeding member to feed the recording medium while calibrating the feeding amount according to the first calibration value corresponding to the type of recording medium indicated by the type data received by the receiving unit when the judgment unit judges that the recording medium is in contact with the supply roller; and the controller controls the feeding member to feed the recording medium while calibrating the feeding amount according to the second calibration value corresponding to the type indicated by the type data received by the receiving unit when the judgment unit judges that the recording medium is not in contact with the supply roller.

5. The inkjet recording device according to claim 4, further comprising:

a plurality of feeding sections, each capable of accommodating a stack of recording medium;

a plurality of supply rollers in correspondence with the plurality of feeding sections, each of the supply rollers supplying the recording medium one at a time from the corresponding one of the feeding sections, wherein:

the receiving unit further receives tray data identifying one of the plurality of feeding sections;

each of the plurality of first calibration values stored in the memory further corresponds to one of the plurality of feeding sections;

each of the plurality of second calibration values stored in the memory further corresponds to one of the plurality of feeding sections;

the controller controls the feeding member to feed the recording medium while calibrating the feeding amount according to one of the first calibration values corresponding to both the feeding section identified by the tray data received by the receiving unit and the type of recording medium indicated by the type data received by the receiving unit when the judgment unit judges that the recording medium is in contact with the supply roller; and the controller controls the feeding member to feed the recording medium while calibrating the feeding amount according to one of the second calibration values corresponding to both the feeding section identified by the tray data received by the receiving unit and the type of recording medium indicated by the type data received by the receiving unit when the judgment unit judges that the recording medium is not in contact with the supply roller.

6. The inkjet recording device according to claim 1, further comprising a glossiness sensor that detects a glossiness degree of the recording medium, wherein:

the memory stores a plurality of first calibration values each corresponding to one of a plurality of glossiness degrees and a plurality of second calibration values each corresponding to one of the plurality of glossiness degrees;

the controller controls the feeding member to feed the recording medium while calibrating the feeding amount according to one of the first calibration values corresponding to the glossiness degree detected by the glossiness sensor when the judgment unit judges that the recording medium is in contact with the supply roller; and the controller controls the feeding member to feed the recording medium while calibrating the feeding amount according to one of the second calibration values corresponding to the glossiness degree detected by the glossiness sensor when the judgment unit judges that the recording medium is not in contact with the supply roller.

7. The inkjet recording device according to claim 6, further comprising:

a plurality of feeding sections, each capable of accommodating a stack of recording medium;

a plurality of supply rollers in one-to-one correspondence with the plurality of feeding sections, each of the supply rollers supplying the recording medium one at a time from the corresponding one of the feeding sections, wherein:

the receiving unit further receives tray data identifying one of the plurality of feeding sections;

each of the plurality of first calibration values stored in the memory further corresponds to one of the plurality of feeding sections;

each of the plurality of second calibration values stored in the memory further corresponds to one of the plurality of feeding sections;

the controller controls the feeding member to feed the recording medium while calibrating the feeding amount according to one of the first calibration values corresponding to both the feeding section identified by the tray data received by the receiving unit and the glossiness degree detected by the glossiness sensor when the judgment unit judges that the recording medium is in contact with the supply roller; and the controller controls the feeding member to feed the recording medium while calibrating the feeding amount according to one of the second calibration values corresponding to both the feeding section identified by the tray data received by the receiving unit and the glossiness degree detected by the glossiness sensor when the judgment unit judges that the recording medium is not in contact with the supply roller.

8. The inkjet recording device according to claim 1, further comprising:

a plurality of feeding sections, each capable of accommodating a stack of recording medium;

a plurality of supply rollers in one-to-one correspondence with the plurality of feeding sections, each of the supply rollers supplying the recording medium one at a time from the corresponding one of the feeding sections; and a receiving unit that receives tray data identifying one of the plurality of feeding sections, wherein the memory stores a plurality of first calibration values each corresponding to one of the plurality of feeding sections and a plurality of second calibration values each corresponding to one of the plurality of feeding sections;

the controller controls the feeding member to feed the recording medium while calibrating the feeding amount according to one of the first calibration values corresponding to the feeding section identified by the tray data received by the receiving unit when the judgment unit judges that the recording medium is in contact with the supply roller; and the controller controls the feeding member to feed the recording medium while calibrating the feeding amount according to one of the second calibration values corresponding to the feeding section identified by the tray data received by the receiving unit when the judgment unit judges that the recording medium is not in contact with the supply roller.

9. An inkjet recording device comprising:

a feeding section capable of accommodating a stack of recording medium;

a supply roller that supplies the recording medium one at a time from the feeding section;

a recording unit including a recording head that ejects ink onto the recording medium and a carriage that reciprocatingly moves in a first direction while mounting the recording head thereon, wherein the recording unit performs printing operation in which the recording head ejects ink onto the recording medium while the carriage is moving in the first direction;

a feeding member that feeds the recording medium supplied by the supply roller in a second direction substantially perpendicular to the first direction when the recording unit is not performing the printing operation;

a detecting unit that detects an actual paper feeding length by which the recording medium is actually fed;

a controller that controls the feeding member to feed the recording medium;

a memory that stores a first calibration value and a second calibration value; and a calculation unit that performs a predetermined calculation, wherein:

the controller controls the feeding member to feed the recording medium a predetermined distance while calibrating a feeding amount based on the first calibration value;

the detecting unit detects the actual feeding length each time the controller controls the feeding member to feed the recording medium the predetermined distance;

the calculation unit calculates a difference between the sum of the actual paper feeding lengths detected by the detecting unit and the sum of the predetermined distances, wherein the sum of the actual paper feeding lengths indicates a distance the recording medium is actually fed, and the sum of the predetermined distances indicates a distance the recording medium is theoretically fed; and the controller controls the feeding member to feed the recording medium the predetermined distance while calibrating the feeding amount based on the second calibration value if the difference between the sum of the actual paper feeding lengths and the sum of the predetermined distances exceeds a predetermined value, wherein the second calibration value is smaller than the first calibration value.

10. The inkjet recording device according to claim 9, further comprising a receiving unit that receives type data indicating a type of recording medium, wherein:

the memory stores a plurality of first calibration values each corresponding to one of a plurality of types of recording medium and a plurality of second calibration values each corresponding to one of the plurality of types of recording medium;

the controller controls the feeding member to feed the recording medium the predetermined distance while calibrating the feeding amount based on one of the first calibration values corresponding to the type of recording medium indicated by the type data received by the receiving unit;

the controller controls the feeding member to feed the recording medium the predetermined distance while calibrating the feeding amount based on one of the second calibration values corresponding to the type of recording medium indicated by the type data received by the receiving unit if the difference between the sum of the actual paper feeding lengths and the sum of the predetermined distances exceeds the predetermined value.

11. The inkjet recording device according to claim 10, further comprising:

a plurality of feeding sections, each capable of accommodating a stack of recording medium; and a plurality of supply rollers in one-to-one correspondence with the plurality of feeding sections, each of the supply rollers supplying the recording medium one at a time from the corresponding one of the feeding sections, wherein:

the receiving unit further receives tray data identifying one of the plurality of feeding sections;

each of the plurality of first calibration values stored in the memory further corresponds to one of the plurality of feeding sections;

each of the plurality of second calibration values stored in the memory further corresponds to one of the plurality of feeding sections;

the controller controls the feeding member to feed the recording medium the predetermined distance while calibrating the feeding amount based on one of the first calibration values corresponding both to the feeding section identified by the tray data and the type indicated by the type data received by the receiving unit; and the controller controls the feeding member to feed the recording medium the predetermined distance while calibrating the feeding amount based on one of the second calibration values corresponding both to the feeding section identified by the tray data and the type indicated by the type data received by the receiving unit if the difference between the sum of the actual paper feeding lengths and the sum of the predetermined distances exceeds the predetermined value.

12. The inkjet recording device according to claim 9, further comprising a glossiness sensor that detects a glossiness degree of recording medium, wherein:

the memory stores a plurality of first calibration values each corresponding to one of a plurality of glossiness degrees and a plurality of second calibration values each corresponding to one of the plurality of glossiness degrees;

the controller controls the feeding member to feed the recording medium the predetermined distance while calibrating the feeding amount based on one of the first calibration values corresponding to the glossiness degree detected by the glossiness sensor;

the controller controls the feeding member to feed the recording medium the predetermined distance while calibrating the feeding amount based on one of the second calibration values corresponding to the glossiness degree detected by the glossiness sensor if the difference between the sum of the actual paper feeding lengths and the sum of the predetermined distances exceeds the predetermined value.

13. The inkjet recording device according to claim 12, further comprising:

a plurality of feeding sections, each capable of accommodating a stack of recording medium; and a plurality of supply rollers in one-to-one correspondence with the plurality of feeding sections, each of the supply rollers supplying the recording medium one at a time from the corresponding one of the feeding sections, wherein:

the receiving unit further receives tray data identifying one of the plurality of feeding sections;

each of the plurality of first calibration values stored in the memory further corresponds to one of the plurality of feeding sections;

each of the plurality of second calibration values stored in the memory further corresponds to one of the plurality of feeding sections;

the controller controls the feeding member to feed the recording medium the predetermined distance while calibrating the feeding amount based on one of the first calibration values corresponding both to the feeding section identified by the tray data received by the receiving unit and the glossiness degree detected by the glossiness sensor; and the controller controls the feeding member to feed the recording medium the predetermined distance while calibrating the feeding amount based on one of the second calibration values corresponding both to the feeding section identified by the tray data receiving by the receiving unit and the glossiness degree detected by the glossiness sensor if the difference between the sum of the actual paper feeding lengths and the sum of the predetermined distances exceeds the predetermined value.

14. The inkjet recording device according to claim 9, further comprising:

a plurality of feeding sections, each capable of accommodating a stack of recording medium;

a plurality of supply rollers in one-to-one correspondence with the plurality of feeding sections, each of the supply rollers supplying the recording medium one at a time from the corresponding one of the feeding sections; and a receiving unit that receives tray data identifying one of the plurality of feeding sections, wherein the memory stores a plurality of first calibration values each corresponding to one of the plurality of feeding sections and a plurality of second calibration values each corresponding to the plurality of feeding sections;

the controller controls the feeding member to feed the recording medium the predetermined distance while calibrating the feeding amount based on one of the first calibration values corresponding to the feeding section identified by the tray data received by the receiving unit;

the controller controls the feeding member to feed the recording medium the predetermined distance while calibrating the feeding amount based on one of the second calibration values corresponding to the feeding section identified by the tray data received by the receiving unit if the difference between the sum of the actual paper feeding lengths and the sum of the predetermined distances exceeds the predetermined value.

15. An inkjet recording device comprising:

a tray that is capable of accommodating a stack of recording medium;

a supply roller that supplies the recording medium from the tray one at a time;

a recording unit including a recording head that ejects ink onto the recording medium supplied by the supply roller and a carriage that reciprocatingly moves in a first direction while mounting the recording head thereon, wherein the recording unit performs a printing operation where the recording head ejects ink onto the recording medium while the carriage is moving in the first direction;

a feed roller that performs a feeding operation to feed the recording medium supplied by the supply roller in a second direction perpendicular to the first direction when the recording unit is not performing the printing operation;

a memory that stores a contact-time test pattern and a non-contact-time test pattern;

a determining unit that determines whether a recording medium is in contact with the supply roller;

a controller that controls the recording unit and the feed roller to repeatedly perform the printing operation and the feeding operation in alternation so as to form an image on the recording medium, wherein the controller controls the recording unit and the feed roller to perform a test printing where the contact-time test pattern is formed on a first recording medium when the determining unit determines that the first recording medium is in contact with the supply roller and the non-contact-time test pattern is formed on the first recording medium when the determining unit determines that the first recording medium is not in contact with the supply roller;

a judgment unit that judges appropriateness degrees of the contact-time test pattern and the non-contact-time test pattern formed on the first recording medium; and a calculation unit that calculates a first calibration value based on the appropriateness degree of the contact-time test pattern and a second calibration value based on the appropriateness degree of the non-contact-time test pattern, wherein the memory stores the first and second calibration values calculated by the calculation unit;

the controller controls the recording unit and the feed roller to perform a normal printing where an image is formed on a second recording medium; and in the normal printing, the feeding operation is performed while calibrating a feeding amount of the second recording medium according to the first calibration value when the determining unit determines that the second recording medium is in contact with the supply roller and according to the second calibration value when the determining unit determines that the second recording medium is not in contact with the supply roller.

16. The inkjet recording device according to claim 15, further comprising a detection unit that detects a type of the recording medium, wherein:

the first and the second calibration values correspond to a first type of recording medium;

the calculating unit further calculates a third calibration value corresponding to a second type of recording medium differing from the first type based on the first calibration value;

the calculating unit calculates a fourth calibration value corresponding to the second type of recording medium based on the second calibration value;

the memory further stores the third and the fourth calibration values; and the controller controls the recording unit and the feed roller to perform the normal printing where an image is formed on the second recording medium while calibrating a feeding amount according to one of the first to fourth calibration values corresponding to the type of the second recording medium detected by the detecting unit.

17. The inkjet recording device according to claim 15, further comprising an input unit through which a test-pattern information is inputted, wherein the judgment unit judges the appropriateness degrees based on the test-pattern information inputted through the input unit.

18. The inkjet recording device according to claim 15, further comprising a reading unit that reads the contact-time test pattern and the non-contact-time test pattern formed on the first recording medium, wherein the memory further stores a reference, and the judgment unit judges the appropriateness degrees of the contact-time test pattern and the non-contact-time test pattern read by the reading unit, referring to the reference stored in the memory.

19. The inkjet recording device according to claim 18, wherein the recording unit is capable of forming the contact-time test pattern with a first resolution, and the reading unit is capable of reading the contact-time test pattern with a second solution equal to or greater than twice of the first resolution.

20. The inkjet recording device according to claim 15, wherein the controller controls the recording unit and the feed roller to form the contact-time test pattern while calibrating a feeding amount according to a first reference calibration value, and the controller controls the recording unit and the feed roller to form the non-contact-time test pattern while calibrating a feeding amount according to a second reference calibration value differing from the first reference calibration value.

21. An inkjet recording device comprising:

a tray that is capable of accommodating a stack of recording medium;

a supply roller that supplies the recording medium from the tray one at a time;

a recording unit including a recording head that ejects ink onto the recording medium supplied by the supply roller and a carriage that reciprocatingly moves in a first direction while mounting the recording head thereon, wherein the recording unit performs a printing operation where the recording head ejects ink onto the recording medium while the carriage is moving in the first direction;

a feed roller that performs a feeding operation to feed the recording medium supplied by the supply roller in a second direction perpendicular to the first direction when the recording unit is not performing the printing operation;

a memory that stores a test pattern;

a determining unit that determines whether a recording medium is in contact with the supply roller;

a controller that controls the recording unit and the feed roller to repeatedly perform the printing operation and the feeding operation in alternation so as to form an image on the recording medium, wherein the controller controls the recording unit and the feed roller to perform a test printing where the test pattern is formed on a first recording medium when the determining unit determines that the first recording medium is not in contact with the supply roller;

a judgment unit that judges an appropriateness degree of the test pattern formed on the first recording medium; and a calculation unit that calculates a first calibration value based on the appropriateness degree of the test pattern, the calculation unit calculating a second calibration value based on the first calibration value;

the memory further stores the first and second calibration values calculated by the calculation unit;

the controller controls the recording unit and the feed roller to perform a normal printing where an image is formed on a second recording medium while calibrating a feeding amount of the second recording medium according to the second calibration value when the determining unit determines that the second recording medium is in contact with the supply roller and according to the first calibration value when the determining unit determines that the second recording medium is not in contact with the supply roller.

22. The inkjet recording device according to claim 21, further comprising an input unit through which a test-pattern information is inputted, wherein:

the judgment unit judges the appropriateness degree based on the test-pattern information inputted through the input unit.

23. The inkjet recording device according to claim 21, further comprising a reading unit that reads the test pattern formed on the first recording medium, wherein the memory further stores a reference, and the judgment unit judges the appropriateness degree of the test pattern read by the reading unit, referring to the reference stored in the memory.

24. The inkjet recording device according to claim 23, wherein the recording unit is capable of forming the test pattern with a first resolution, and the reading unit is capable of reading the test pattern with a second solution equal to or greater than twice of the first resolution.

* * * * *